US006035793A

United States Patent [19]

Nishio

[11] Patent Number: 6,035,793

[45] Date of Patent: Mar. 14, 2000

[54] APPARATUS FOR SUPPLYING BELT-LOOP MATERIAL TO SEWING MACHINE

[75] Inventor: Akira Nishio, Aichi-ken, Japan

[73] Assignee: Brother Kogyo Kabushiki Kaisha, Nagoya, Japan

[21] Appl. No.: 09/082,152

[22] Filed: May 21, 1998

[30] Foreign Application Priority Data

May 27, 1997 [JP] Japan ..... 9-154444
Nov. 14, 1997 [JP] Japan ..... 9-331249

[51] Int. Cl.[7] ..... D05B 19/12; D05B 33/02

[52] U.S. Cl. ..... 112/470.34; 112/152; 112/163; 112/475.03; 112/475.07

[58] Field of Search ..... 112/470.34, 470.33, 112/470.03, 470.05, 470.07, 475.03, 475.09, 475.07, 130, 152, 153, 163

[56] References Cited

U.S. PATENT DOCUMENTS 751,398 2/1904 Hughes ..... 112/152
1,027,009 5/1912 Smeja ..... 112/152
3,515,081 6/1970 Miller ..... 112/152 X
4,632,047 12/1986 Seaman ..... 112/130 X
5,394,813 3/1995 Shimoyama et al. ..... 112/130 X

FOREIGN PATENT DOCUMENTS 1-284285 11/1989 Japan .

*Primary Examiner*—Peter Nerbun
*Attorney, Agent, or Firm*—Oliff & Berridge, PLC

[57] ABSTRACT

An apparatus for supplying, to a sewing device, a connected belt-loop material including at least one connection portion where two long materials are connected to each other, the connection portion having a width greater than a substantially constant width of a remaining portion of the belt-loop material, the apparatus including a feeding device which feeds the belt-loop material toward the sewing device, and a positioning device which positions, in a direction extending parallel to the width of the belt-loop material, at least the remaining portion of the belt-loop material being fed by the feeding device, so that the remaining portion takes a reference position in the direction of width, the positioning device including a permitting device which permits the connection portion of the belt-loop material to be fed through the positioning device by the feeding device, without lowering an accuracy with which the remaining portion of the belt-loop material is positioned by the positioning device in the direction extending parallel to the width.

20 Claims, 19 Drawing Sheets

APPARATUS FOR SUPPLYING BELT-LOOP MATERIAL TO SEWING MACHINE

BACKGROUND OF THE INVENTION

1. Field of the Invention

The present invention generally relates to an apparatus for supplying a belt-loop material to a cutting device of a sewing system and particularly relates to the art of positioning the belt-loop material in the direction of width thereof.

2. Related Art Statement

There is known a sewing system which sews belt-loop pieces to a material of a garment such as a pair of trousers, or a skirt, so that a belt may pass through the belt loops made of the belt-loop pieces. The known sewing system includes a twin-needle sewing machine which sews the belt-loop pieces to the garment material, and a belt-loop-piece ("BLP") supplying device, a cutting device, and a belt-loop-material ("BLM") supplying device which are provided in the vicinity of the sewing machine. The BLM supplying device supplies, in each operation cycle, a predetermined length of a connected belt-loop material including one or more connection portions where two long materials are connected to each other, to the cutting device, which cuts off the predetermined length of the material and provides a belt-loop piece having two straight or V-shaped cut ends. The BLP supplying device supplies the belt-loop piece to the twin-needle sewing machine from its lateral side, that is, to a sewing position where the sewing machine sews the belt-loop piece to the garment material.

FIG. 21 shows a known BLM supplying device 130 and a known cutting device 50 of a known sewing system. The BLM supplying device 130 includes a horizontal support plate 32 which is provided in the vicinity of the cutting device 50. The support plate 32 supports a first and a second guide member 133, 134 such that the two guide members 133, 134 extend parallel to each other, in a feeding direction, F, in which a connected belt-loop material 7 is fed toward the cutting device 50 by a feeder roller 41. Each guide member 133, 134 is attached to the support plate 32 with two screws 135 such that a position of each guide member in a direction perpendicular to the feeding direction F is adjustable. The feeder roller 41 is provided at a position corresponding to a downstream end portion of the support plate 32 as seen in the feeding direction F. The support plate 32 and the two guide members 133, 134 cooperate with one another to provide or define a straight guide groove 136 which guides a front end portion of the connected belt-loop material 7 delivered from a BLM storing device (not shown) including a reel around which the belt-loop material 7 is wound.

Each time the feeder roller 41 is rotated by a drive motor (not shown) to supply a predetermined length of the belt-loop material 7 to the cutting device 50, a fixed and a movable blade 59, 60 of the cutting device 50 cooperate with each other to cut off the predetermined length of the material 7 by two cutting operations, that is, the first cutting operation carried out at a position indicated in solid lines and the second cutting operation carried out at a position indicated in two-dot chain lines. Thus, a belt-loop piece having two V-shaped cut ends is obtained. Meanwhile, it is also known to cut off a predetermined length of the material 7 by a single cutting operation and thereby obtain a belt-loop piece having two straight cut ends. However, in the case where opposite end portions of the belt-loop piece having the V-shaped cut ends are folded back, the folded-back end portions having the V-shaped cut ends are well covered by the remaining, intermediate portion of the belt-loop piece, even if those end portions may be folded back with low accuracy. Therefore, it is a recent common manner to cut a belt-loop material 7 into belt-loop pieces having V-shaped cut ends.

By the way, the connected belt-loop material 7 stored in the BLM storing device includes, as shown in FIG. 6, a plurality of connection portions 7*a* (only one 7*a* is shown in FIG. 6) at a substantially regular interval of distance. Each connection portion 7*a* has a width greater than that of the remaining portion of the belt-loop material 7. Therefore, one or each of the respective positions of the two guide members 133, 134 is adjusted so that the width of the guide groove 136 is equal to the width of each connection portion 7*a* and accordingly each connection portion 7*a* can smoothly pass through the guide groove 136. However, the belt-loop piece including the connection portion 7*a* is discarded, that is, is not used for sewing a belt loop to a garment material.

However, the remaining portions other than the connection portions 7*a* have a width which is smaller than those of the connection portions 7*a* and accordingly is smaller than that of the guide groove 136. It is the remaining portions that are used to provide useful belt-loop pieces. In the known BLM supplying device 130, each remaining portion cannot be accurately positioned, in a widthwise direction of the guide groove 136, relative to a cutting position where the fixed and movable blades 59, 60 of the cutting device 50 cut the belt-loop material 7. Therefore, the shape of the V-shaped cut ends of the belt-loop pieces cannot be stabilized, and accordingly the accuracy of cutting of the belt-loop material cannot be improved.

SUMMARY OF THE INVENTION

It is therefore an object of the present invention to provide a belt-loop-material supplying apparatus which supplies a belt-loop material while accurately positioning the belt-loop material in a direction of width thereof.

It is another object of the present invention to provide a sewing system including a belt-loop-material cutting device and a belt-loop-material supplying apparatus which supplies a belt-loop material while accurately positioning the belt-loop material in a direction of width thereof relative to the cutting device.

The present invention provides a belt-loop-material supplying apparatus and a sewing system which have one or more of the technical features which are described below in respective paragraphs given parenthesized sequential numbers (1) to (32). Any technical feature which includes another technical feature shall do so by referring, at the beginning, to the parenthesized sequential number given to that technical feature. Thus, two or more of the following technical features may be combined, if appropriate. Each technical feature may be accompanied by a supplemental explanation, as needed.

(1) According to a first feature of the present invention, there is provided an apparatus for supplying, to a sewing device, a connected belt-loop material including at least one connection portion where two long materials are connected to each other, the connection portion having a width greater than a substantially constant width of a remaining portion of the belt-loop material, the apparatus comprising a feeding device which feeds the belt-loop material toward the sewing device; and a positioning device which positions, in a direction of width of the belt-loop material, at least the remaining portion of the belt-loop material being fed by the feeding device, so that the remaining portion takes a first reference position in the direction of width, the positioning device comprising a permitting device which permits the connection portion of the belt-loop material to be fed through the positioning device by the feeding device, without lowering an accuracy with which the remaining portion of the belt-loop material is positioned by the positioning device in the direction of width. In the present belt-loop-material ("BLM") supplying apparatus, the positioning device accurately positions, in the direction of width of the belt-loop material, at least the remaining portion of the belt-loop material being fed by the feeding device, so that the remaining portion accurately takes a first reference position in the direction of width, while the permitting device permits the connection portion to be fed through the positioning device by the feeding device, without lowering the accuracy with which the remaining portion is positioned by the positioning device in the direction of width. Therefore, in the case where a cutting device is provided on a downstream side of the present BLM supplying apparatus in a feeding direction in which the belt-loop material is fed by the feeding device, the remaining portion of the belt-loop material is accurately positioned relative to the cutting device in the direction of width of the material. Thus, the present BLM supplying apparatus contributes to stabilizing the shape of cut ends of belt-loop pieces cut from the belt-loop material by the cutting device. The belt-loop pieces obtained from the remaining portion of the belt-loop material are used by a sewing machine for sewing belt loops to a garment material. The belt-loop piece including the connection portion may be discarded.

(2) According to a second feature of the present invention which includes the first feature (1), the permitting device comprises a connection-portion positioning device which permits the connection portion to be fed by the feeding device, while positioning the connection portion in the direction of width so that the connection portion takes a second reference position in the direction of width. The present BLM supplying apparatus accurately positions not only the remaining portion but also the connection portion in the direction of width of the belt-loop material. However, the connection portion may not be accurately positioned in the direction of width, in particular, in the case where the connection portion is discarded. The second reference position taken by the connection portion may be equal to, or different from, the first reference position taken by the remaining portion.

(3) According to a third feature of the present invention which includes the second feature (2), the connection-portion positioning device comprises a guide member which guides each of the connection portion and the remaining portion of the belt-loop material being fed by the feeding device; and a biasing device which biases the each of the connection portion and the remaining portion toward the guide member in the direction of width, and thereby positions the connection portion at the second reference position and the remaining portion at the first reference position different from the second reference position. In the present apparatus, each of the connection portion and the remaining portion of the belt-loop material is fed toward the cutting device while being biased by the biasing device against the guide member in the direction of width of the material. Though the connection portion has a width greater than that of the remaining portion, the biasing device permits the connection portion to be fed by the feeding device.

(4) According to a fourth feature of the present invention which includes the third feature (3), the biasing device comprises at least one leaf spring member which extends in an oblique direction having a first directional component toward the guide member and a second directional component parallel to a direction in which the belt-loop material is fed by the feeding device, and wherein the connection-portion positioning device further comprises a support member which supports the leaf spring member such that the leaf spring member extends in the oblique direction. When the connection portion passes through the positioning device, the one or more leaf spring members are elastically deformed to permit the connection portion to be easily and smoothly fed through the positioning device by the feeding device.

(5) According to a fifth feature of the present invention which includes the fourth feature (4), the positioning device further comprises a changing device for changing a distance between the guide member and the support member in the direction of width. An operator or a user can operate the changing device for changing the distance between the guide member and the support member in the direction of width, depending upon the width of the belt-loop material to be used.

(6) According to a sixth feature of the present invention which includes the second feature (2), the connection-portion positioning device comprises two movable guide members which cooperate with each other to guide each of the connection portion and the remaining portion of the belt-loop material being fed by the feeding device, and thereby position the connection portion at the second reference position and the remaining portion at the first reference position equal to the second reference position; and a moving device for simultaneously moving the two guide members in opposite directions parallel to the direction of width, respectively, such that respective distances of the two guide members from a reference line are kept equal to each other. In the present BLM supplying apparatus, when one of the two guide members is moved in a first direction parallel to the direction of width of the belt-loop material, the other guide member is simultaneously moved in a second direction opposite to the first direction, by the same distance as the distance by which the first guide member is moved in the first direction. Thus, the two movable guide members can position each of the connection portion and the remaining portion at the same reference position in the direction of width of the material, such that respective center lines of the connection portion and the remaining portion are aligned with the reference line. In the case where the cutting device is provided in alignment with the reference line, each of the connection portion and the remaining portion is accurately positioned relative to the cutting device, and the shape of the cut ends of the belt-loop pieces obtained from the belt-loop material is stabilized.

(7) According to a seventh feature of the present invention which includes the sixth feature (6), the moving device comprises two rack members which are fixed to the two movable guide members, respectively, and each of which has a plurality of teeth arranged in the direction of width; and a pinion which is rotatable about an axis line perpendicular to the direction of width and which is engaged with the teeth of each of the two rack members. The first and second guide members can be simultaneously moved toward, or away from, each other in the direction of width of the belt-loop material, symmetrically with respect to the reference line, because the pinion is rotated and the first and second rack members are moved in opposite directions, respectively.

(8) According to an eighth feature of the present invention which includes the seventh feature (7), the moving device further comprises at least one biasing device which biases the two movable guide members toward each other and which permits the two guide members to be moved away from each other. When the belt-loop material is fed through the positioning device, the biasing device permits the two guide members to automatically move and thereby change the distance therebetween depending upon the width of each of the connection portion and the remaining portion. In particular, when the connection portion passes, the biasing device permits the two guide members to be moved away from each other, that is, permits the distance between the two guide members to be increased, thereby permitting the connection portion to be easily and smoothly fed through the positioning device.

(9) According to a ninth feature of the present invention which includes the seventh or eighth feature (7) or (8), the moving device further comprises an actuator which moves one of the two movable guide members in each one of the opposite directions, and thereby moves the other guide member in the other direction. The actuator may be an air-cylinder device, a stepper motor, or a linear-solenoid device which is controllable regarding its operation amount based on an operation-command (i.e., drive) signal supplied thereto.

(10) According to a tenth feature of the present invention which includes the ninth feature (9), the moving device further comprises a detector provided on an upstream side of the guide members in a direction in which the belt-loop material is fed by the feeding device, the detector detecting the connection portion and generating a detection signal indicating that the detector has detected the connection portion; and a control device which controls the actuator based on the detection signal.

(11) According to an eleventh feature of the present invention which includes the tenth feature (10), the detector comprises a sensor which detects at least one of a width and a thickness of each of the connection portion and the remaining portion of the belt-loop material. In the case where the sensor detects the width of each of the connection portion and the remaining portion, the control device can control the actuator to automatically move one guide member and thereby simultaneously move the other guide member so that the distance between the two guide members is changed (increased or decreased) to be equal to the width of each of the connection portion and the remaining portion.

(12) According to a twelfth feature of the present invention which includes the second feature (2), the connection-portion positioning device comprises a first biasing device which biases each of the connection portion and the remaining portion of the belt-loop material being fed by the feeding device, in one of opposite directions parallel to the direction of width; and a second biasing device which biases the each of the connection portion and the remaining portion in the other direction and cooperates with the first biasing device to position the connection portion at the second reference position and the remaining portion at the first reference position equal to the second reference position. In the present BLM supplying apparatus, each of the connection portion and the remaining portion is accurately positioned relative to the cutting device in the direction of width of the belt-loop material, and accordingly the shape of cut ends of the belt-loop pieces obtained from the belt-loop material is stabilized.

(13) According to a thirteenth feature of the present invention which includes the twelfth feature (12), the first biasing device comprises at least one first leaf spring member which extends in a first oblique direction having a first directional component parallel to the one direction and a second directional component parallel to a feeding direction in which the belt-loop material is fed by the feeding device, and the second biasing device comprises at least one second leaf spring member which extends in a second oblique direction having a third directional component parallel to the other direction and a fourth directional component parallel to the feeding direction.

(14) According to a fourteenth feature of the present invention which includes the first feature (1), the permitting device comprises a non-positioning device which permits, without positioning the connection portion in the direction of width, the connection portion to be fed by the feeding device. In the case where the belt-loop piece including the connection portion is discarded, it is not needed to position the connection portion relative to the cutting device in the direction of width of the belt-loop material.

(15) According to a fifteenth feature of the present invention which includes the fourteenth feature (14), the positioning device comprises two guide members which cooperate with each other to guide the remaining portion of the belt-loop material being fed by the feeding device, and thereby position the remaining portion in the direction of width, and the non-positioning device comprises a moving device which moves one of the two guide members in the direction of width to a position where the one guide member is distant from the other guide member by more than the width of the connection portion. The moving device may be an air-cylinder device, a stepper motor, or a linear-solenoid device which is controllable regarding its operation amount based on an operation-command (i.e., drive) signal supplied thereto. In the present BLM supplying apparatus, the moving device may be adapted to move one guide member relative to the other guide member so that the distance between the two guide members is equal to the width of the remaining portion of the belt-loop material. Thus, the remaining portion is accurately positioned relative to the cutting device in the direction of width of the material, and accordingly the shape of the cut ends of the belt-loop pieces obtained from the belt-loop material is stabilized. When the connection portion passes through the positioning device, the moving device can move one guide member to a position where the one guide member is distant from the other guide member by more than the width of the connection portion. Thus, the connection portion is permitted to be easily and smoothly fed through the positioning device. The moving device may be adapted to move the other guide member as well. Alternatively, another moving device may be employed for moving the other guide member.

(16) According to a sixteenth feature of the present invention which includes the fifteenth feature (15), the non-positioning device further comprises a detector provided on an upstream side of the guide members in a direction in which the belt-loop material is fed by the feeding device, the detector detecting the connection portion and generating a detection signal indicating that the detector has detected the connection portion; and a control device which controls the moving device based on the detection signal. When the detector detects the connection portion, the control device controls the moving device to move one guide member to a position where the one guide member is distant from the other guide member by more than the width of the connection portion.

(17) According to a seventeenth feature of the present invention which includes the sixteenth feature (16), the detector comprises a sensor which detects at least one of a thickness and a width of each of the connection portion and the remaining portion of the belt-loop material.

(18) According to an eighteenth feature of the present invention which includes the first feature (1), the permitting device comprising a first permitting device which permits the connection portion of the belt-loop material to be fed by the feeding device, such that a first center line of the connection portion fed by the feeding device is not aligned, in the direction of width, with a second center line of the remaining portion positioned by the positioning device, the first and second center lines being parallel to a direction in which the belt-loop material is fed by the feeding device.

(19) According to a nineteenth feature of the present invention which includes the eighteenth feature (18), the first permitting device comprises a guide member which guides each of the connection portion and the remaining portion of the belt-loop material being fed by the feeding device; and a biasing device which biases the each of the connection portion and the remaining portion toward the guide member in the direction of width.

(20) According to a twentieth feature of the present invention which includes the eighteenth feature (18), the positioning device comprises two guide members which cooperate with each other to guide the remaining portion of the belt-loop material being fed by the feeding device, thereby position the remaining portion in the direction of width, and wherein the first permitting device comprises a moving device which moves one of the two guide members in the direction of width to a position where the one guide member is distant from the other guide member by more than the width of the connection portion.

(21) According to a twenty-first feature of the present invention which includes the first feature (1), the permitting device comprising a second permitting device which permits the connection portion of the belt-loop material to be fed by the feeding device, such that a first center line of the connection portion fed by the feeding device is aligned, in the direction of width, with a second center line of the remaining portion positioned by the positioning device, the first and second center lines being parallel to a direction in which the belt-loop material is fed by the feeding device.

(22) According to a twenty-second feature of the present invention which includes the twenty-first feature (21), the second permitting device comprises two movable guide members which cooperate with each other to guide each of the connection portion and the remaining portion of the belt-loop material being fed by the feeding device, and thereby position the each of the connection portion and the remaining portion in the direction of width; and a moving device for simultaneously moving the two guide members in opposite directions parallel to the direction of width, respectively, such that respective distances of the two guide members from a reference line are kept equal to each other.

(23) According to a twenty-third feature of the present invention which includes the twenty-first feature (21), the second permitting device comprises a first biasing device which biases each of the connection portion and the remaining portion of the belt-loop material being fed by the feeding device, in one of opposite directions parallel to the direction of width; and a second biasing device which biases the each of the connection portion and the remaining portion in the other direction and cooperates with the first biasing device to position the each of the connection portion and the remaining portion in the direction of width.

(24) According to a twenty-fourth feature of the present invention which includes the first feature (1), the positioning device comprises two guide members which cooperate with each other to guide the remaining portion of the belt-loop material being fed by the feeding device, and thereby position the remaining portion in the direction of width; and a changing device for changing a distance between the two guide members in the direction of width, depending upon the width of the remaining portion.

(25) According to a twenty-fifth feature of the present invention which includes the twenty-fourth feature (24), the changing device comprises a moving device which moves at least one of the two guide members in the direction of width.

(26) According to a twenty-sixth feature of the present invention which includes the twenty-fourth feature (24), the changing device comprises a moving device for simultaneously moving the two guide members in opposite directions parallel to the direction of width, respectively, such that respective distances of the two guide members from a reference line are kept equal to each other.

(27) According to a twenty-seventh feature of the present invention which includes the first feature (1), the positioning device comprises a biasing device which biases the remaining portion in the direction of width, and thereby positions the remaining portion in the direction of width.

(28) According to a twenty-eighth feature of the present invention which includes the twenty-seventh feature (27), the positioning device further comprises a guide member which guides the remaining portion of the belt-loop material being fed by the feeding device, and wherein the biasing device comprises at least one biasing member which biases the remaining portion toward the guide member.

(29) According to a twenty-ninth feature of the present invention which includes the twenty-seventh feature (27), the biasing device comprises at least one first biasing member which biases the remaining portion of the belt-loop material being fed by the feeding device, in one of opposite directions parallel to the direction of width; and at least one second biasing member which biases the remaining portion in the other direction.

(30) According to a thirtieth feature of the present invention, there is provided a sewing system, comprising a belt-loop-material supplying apparatus according to the first feature (1); a cutting device which is provided on a downstream side of the positioning device of the supplying apparatus in a direction in which the belt-loop material is fed by the feeding device of the supplying apparatus, the cutting device cutting the belt-loop material supplied by the supplying apparatus, into a plurality of belt-loop pieces; and a sewing machine which sews each of the belt-loop pieces to a garment material. In the present sewing system, the BLM supplying apparatus supplies the belt-loop material to the cutting device while accurately positioning the remaining portion of the material relative to the cutting device in the direction of width of the material, and the cutting device cuts the material into a plurality of belt-loop pieces whose cut ends have a uniform shape. Thus, the present sewing system can sew a garment having excellent belt loops.

(31) According to a thirty-first feature of the present invention which includes the thirtieth feature (30), the positioning device of the supplying apparatus is provided adjacent to the cutting device, and wherein the positioning device positions a predetermined length of the remaining portion of the belt-loop material being fed by the feeding device, at the first reference position relative to the cutting device in the direction of width.

(32) According to a thirty-second feature of the present invention which includes the thirtieth or thirty-first feature (30) or (31), the cutting device comprises a V-shaped-end cutter which cuts the belt-loop material into the belt-loop pieces each of which has two V-shaped cut ends. Since the ELM supplying apparatus supplies the belt-loop material while accurately positioning the remaining portion relative to the cutting device, the cutting device cuts the remaining portion into a plurality of belt-loop pieces whose V-shaped cut ends have a uniform shape.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
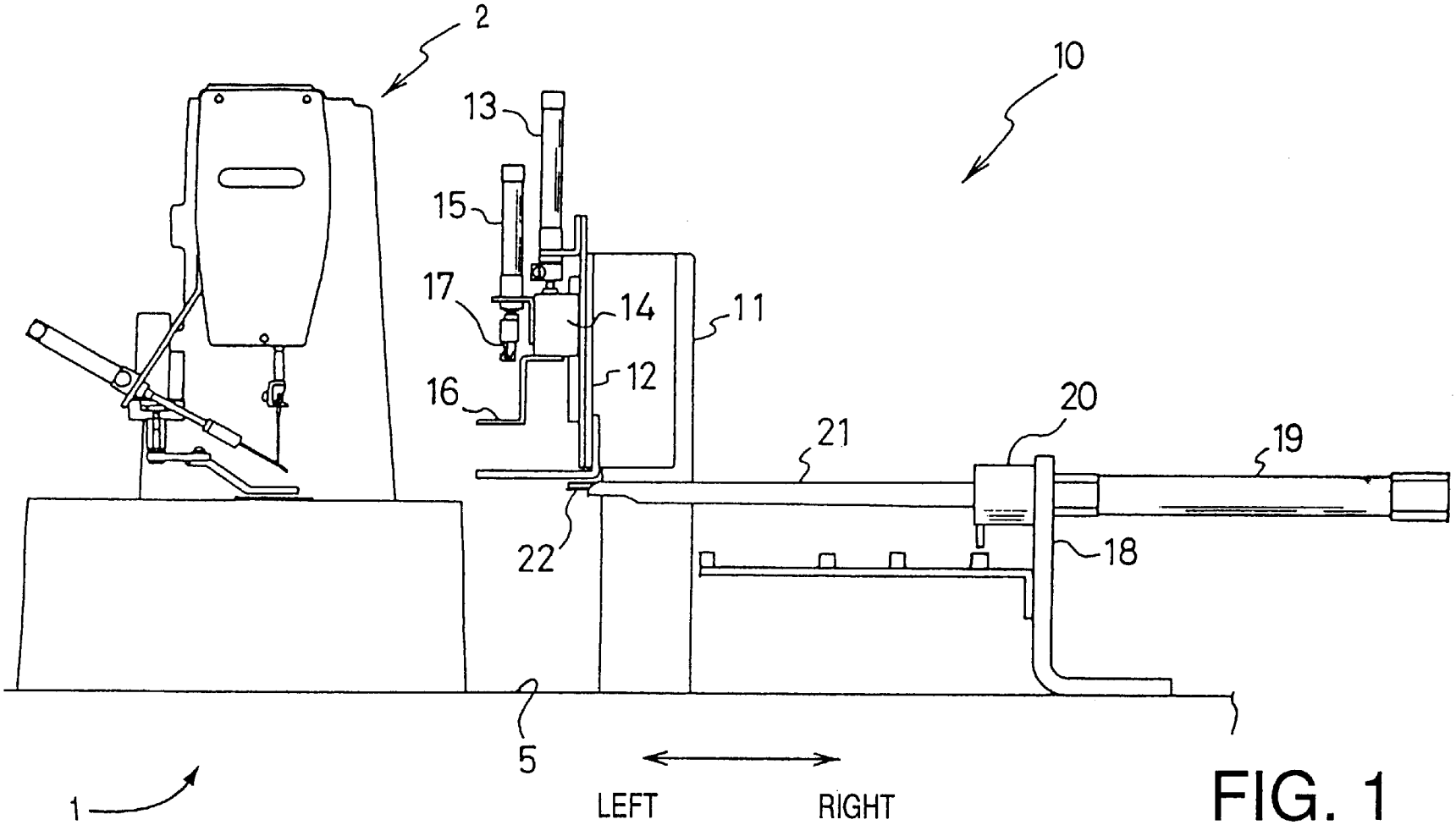
FIG. 1 is a front elevation view of a sewing system including a twin-needle sewing machine and a belt-loop-piece ("BLP") supplying device, the sewing system embodying the present invention.
Figure 2:
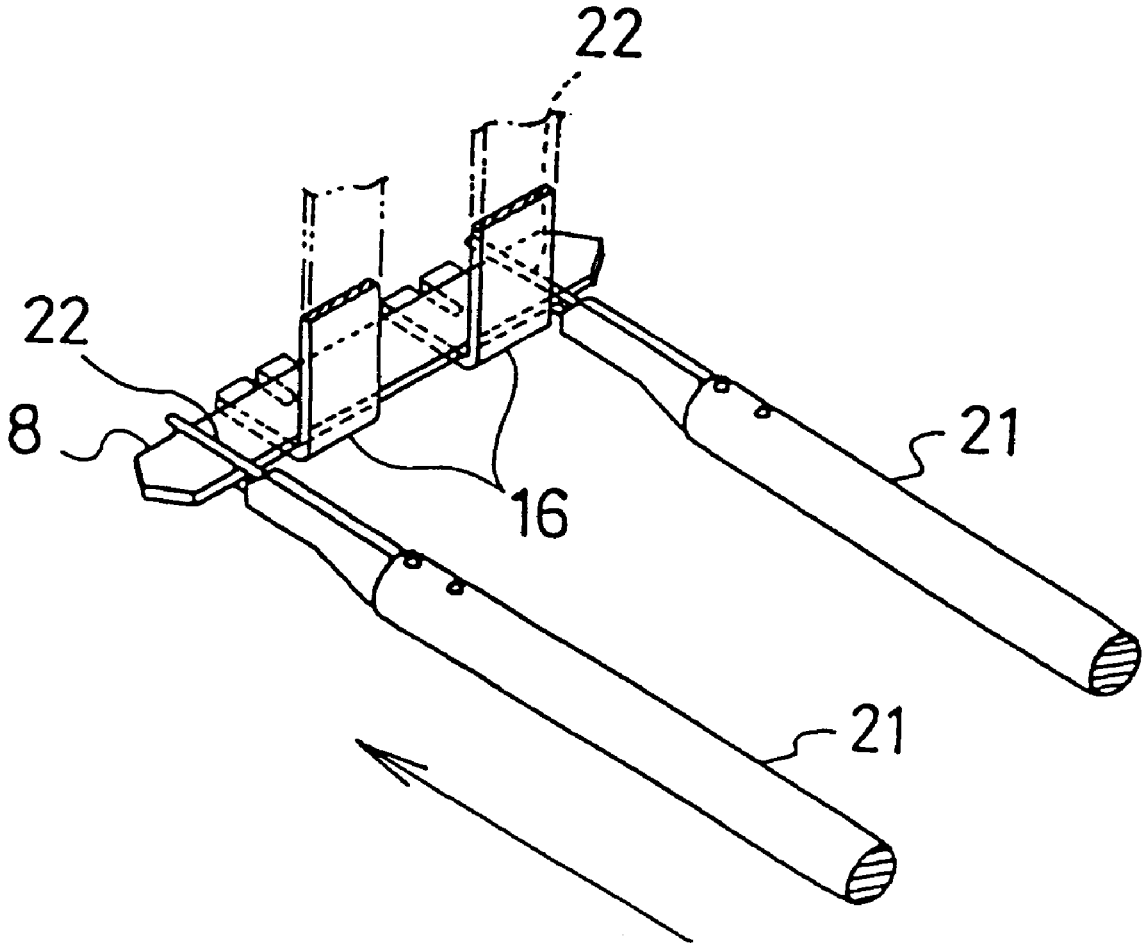
FIG. 2 is a perspective view of a portion of the BLP supplying device of FIG. 1.
Figure 4:
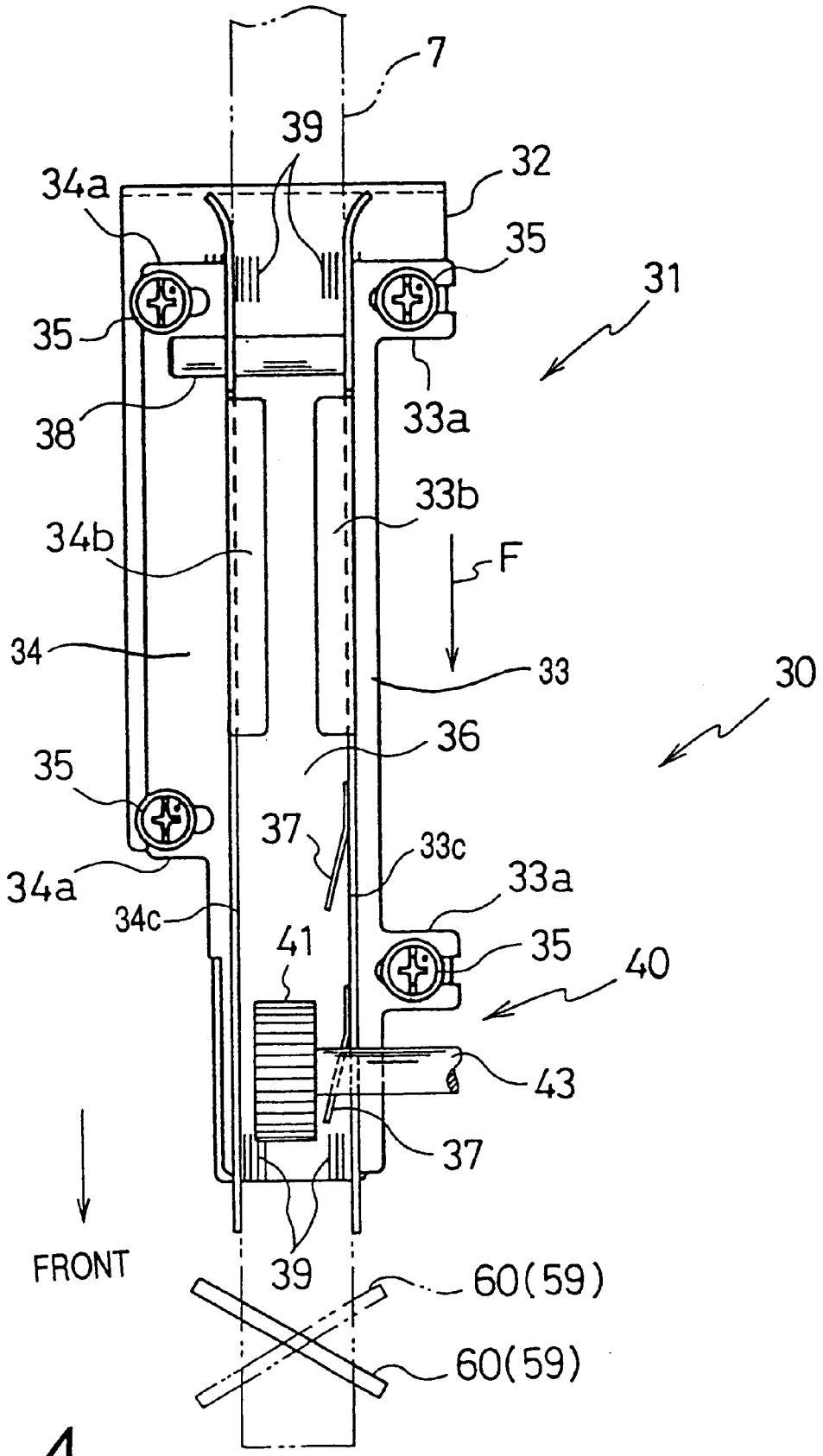
FIG. 4 is a plan view of the BLM supplying device of FIG. 3.
Figure 5:
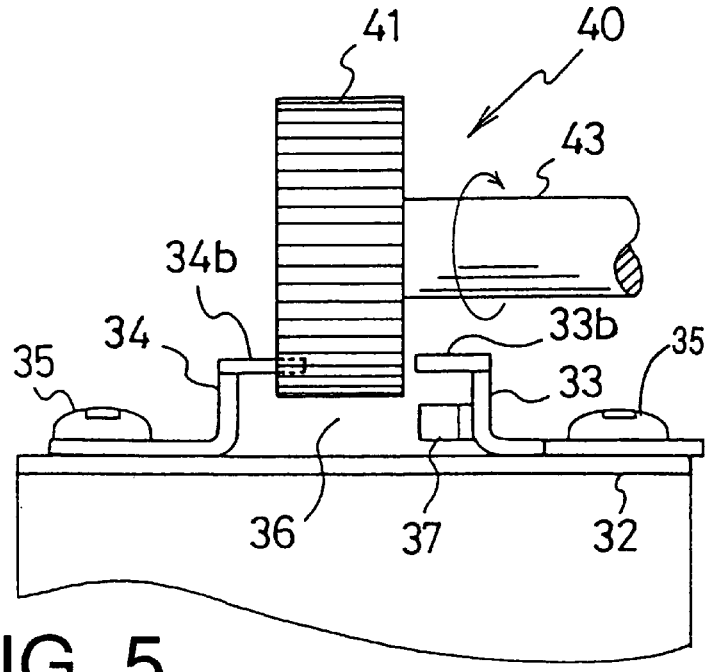
FIG. 5 is a front elevation view of the BLM supplying device of FIG. 3.
Figure 6:
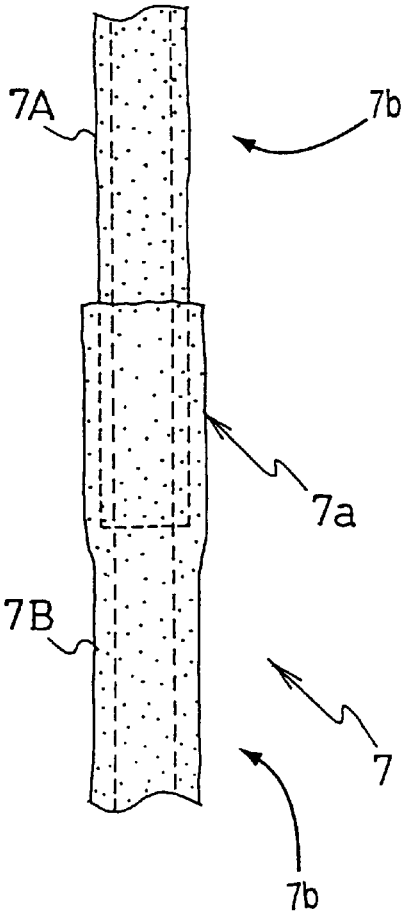
FIG. 6 is a plan view of a belt-loop material including a connection portion where two long materials are connected to each other.

Referring first to FIGS. 1 to 11, there will be described a belt-loop-material ("BLM") supplying apparatus 30 which is employed in a sewing system 1 which additionally employs a cutting device 50, a belt-loop-piece ("BLP") supplying device 10, and a twin-needle sewing machine 2. The present invention applies to the sewing system 1 and the BLM supplying apparatus 30. The BLM supplying apparatus 30 supplies a connected belt-loop material 7 (FIG. 6) to the cutting device 50 (FIG. 3), which cuts the belt-loop material 7 into a plurality of belt-loop pieces 8 (FIG. 2). As shown in FIG. 6, the connected belt-loop material 7 includes at least one connection portion 7*a* where two long materials 7A, 7B are connected, by sewing, to each other. Widthwise opposite end portions of each long material 7A, 7B are folded back and sewn in a lengthwise direction thereof. The connection portion 7*a* has a width greater than a substantially constant width of each of respective remaining portions 7*b* of the long materials 7A, 7B. The belt-loop piece 8 including the connection portion 7*a* is discarded, and only the belt-loop pieces 8 obtained from the remaining portions 7*b* are used. The BLP supplying device 10 supplies the belt-loop pieces 8 one by one to the sewing machine 2, which sews the belt-loop pieces 8 to a material (e.g., fabric or leather) of a garment, such as a pair of trousers or a skirt, so that a belt may be worn through the belt loops formed of the pieces 8.

Figure 3:
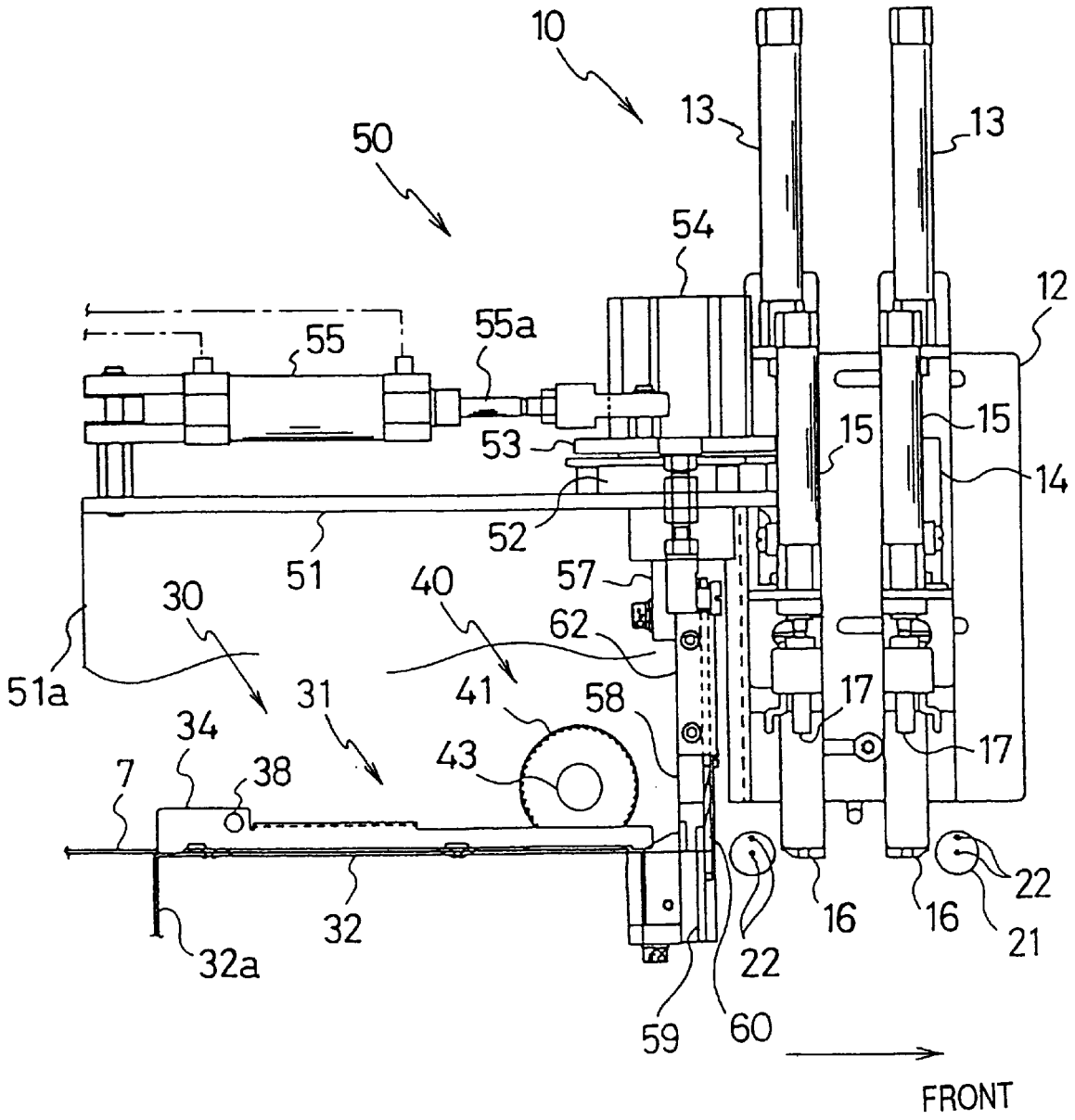
FIG. 3 is a side elevation view of the BLP supplying device of FIG. 1, and a belt-loop-material ("BLM") supplying device and a cutting device of the sewing system of FIG. 1, the BLM supplying device embodying the present invention.

As shown in FIGS. 1 to 3, the BLP supplying device 10, the BLM supplying device 30, and the cutting device 50 are provided in the vicinity of the twin-needle sewing machine 2.

The BLM supplying apparatus 30 supplies, in each operation cycle, a predetermined length of the belt-loop material 7 to the cutting device 50, which cuts off, in each operation cycle, a belt-loop piece 8 having the predetermined length. The BLP supplying device 10 supplies the belt-loop piece 8 to the sewing machine 2 from its lateral side, more specifically, a sewing position where the sewing machine 2 sews the piece 8 to the garment material.

The BLP supplying device 10 will be briefly described below. As shown in FIGS. 1 to 3, the sewing system 1 includes a table 5 on which a support member 11 stands. The support member 11 supports a mount plate 12 fixed thereto.

The mount plate 12 supports two first air-cylinder ("AC") devices 13 each of which is oriented downward. Two block members 14 are fixed to respective lower end portions of respective piston rods of the two first AC devices 13, and two second AC devices 15 are fixed to the two block members 14, respectively, such that each of the second AC devices 15 is oriented downward. Two press members 17 are fixed to respective lower end portions of respective piston rods of the two second AC devices 15, and cooperate with two press plates 16, respectively, to press each belt-loop piece 8.

Two third AC devices 19 are fixed via a metal member 18 to the table 5, and two rotating AC devices 20 are fixed to respective end portions of respective piston rods of the two third AC devices 19. Two rods 21 are fixed to respective output shafts of the two rotating AC devices 20, and two fork-like belt-loop-piece ("BLP") holders 22 are provided at respective end portions of the two rods 21.

When the BLM supplying apparatus 30 which will be described later has supplied a predetermined length of the belt-loop material 7 to the BLP supplying device 10 and the two second AC devices 15 of the supplying device 10 have been operated so that the two press members 17 cooperate with the two press plates 16 to sandwich the predetermined length of the belt-loop material 7 therebetween, the cutting device 50 which will be described later cuts off the predetermined length of the belt-loop material 7, thereby providing the belt-loop piece 8 having the predetermined length.

Subsequently, as shown in FIG. 2, the third AC devices 19 are operated so that the BLP holders 22 are moved forward (i.e., leftward in FIG. 1), and holds the belt-loop piece 8. Then, the rotating AC devices 20 are operated so that opposite end portions of the belt-loop piece 8 are bent downward. In this state, the third AC devices 19 are further operated so that the belt-loop piece 8 is moved to the sewing position of the twin-needle sewing machine 2 where the two needles of the sewing machine 2 perform bar-tack sewing at the two end portions of the belt-loop piece 8, respectively.

Referring next to FIGS. 3 to 5, there will be described the BLM supplying apparatus 30 which is provided in rear of the BLP supplying device 10.

The BLM supplying apparatus 30 includes a guide device 31 having a guide groove 36 which guides the belt-loop material 7; two leaf springs 37 which elastically bias the belt-loop material 7; and a feeding device 40 which feeds the belt-loop material 7 being guided through the guide groove 36, in a feeding direction, F, (FIG. 4) toward the cutting device 50.

First, the guide device 31 will be described. The guide device 31 includes an elongate support plate 32 which is elongate in a direction parallel to the feeding direction F and which takes a horizontal attitude. The support plate 32 includes a vertical portion 32*a* which extends downward from a rear end thereof and which is fixed to the table 5. The support plate 32 supports a first and a second guide member 33, 34 which include respective vertical wall portions 33*c*, 34*c* which extend parallel to each other in a direction parallel to the feeding direction F and which are opposed to each other in a direction perpendicular to the feeding direction F. The first and second guide members 33, 34 are provided by two separate members, respectively. The first guide member 33 includes two attachment portions 33*a* which are fixed with respective screws 35 to the support plate 32 such that a position of the first guide member 33 in the direction perpendicular to the feeding direction F is adjustable; and the second guide member 34 includes two attachment portions 34*a* which are fixed with respective screws 35 to the support plate 32 such that a position of the second guide member 34 in the direction perpendicular to the feeding direction F is adjustable. Thus, a width of the guide groove 36, i.e., a distance between the respective vertical wall portions 33*c*, 34*c* of the first and second guide members 33, 34 in the direction perpendicular to the feeding direction F is adjustable by moving one or both of the wall portions 33*c*, 34*c* in the same direction.

The support plate 32 and the two guide members 33, 34 cooperate with one another to provide the guide groove 36 which linearly guides a predetermined length of a front end portion of the connected belt-loop material 7 including one or more connection portions 7*a*.

The two guide members 33, 34 additionally includes respective stopper portions 33*b*, 34*b* which are bent toward each other from respective rear portions of the vertical wall portions 33*c*, 34*c* and which have a predetermined length in a direction parallel to the feeding direction F. The two stopper portions 33*b*, 34*b* cooperate with each other to prevent the belt-loop material 7 from jumping up from the guide groove 36. Two elastically deformable leaf-spring members 37 are fixed, at their respective end portions, by welding, to an inner surface of a front portion of the vertical wall portion 33*a* of the first guide member 33, such that the respective end portions of the two spring members 37 are spaced from each other by a predetermined distance in a direction parallel to the feeding direction F. The two spring members 37 provide a biasing device, and each spring member 37 provides a biasing member.

Each of the long materials 7A, 7B of the belt-loop material 7 is a cloth having a constant width of about 13 mm, and the belt-loop material 7 is stored in a belt-loop-material ("BLM") storing device (not shown) including a reel around which the material 7 is wound. The BLM storing device is provided on an upstream side of the BLM supplying device 30 in the feeding direction F. The two long materials 7A, 7B which have a predetermined length are connected to each other such that one of opposite end portions of one long material 7A is inserted in, and jointed with, one of opposite end portions of another long material 7B. Thus, two or more long materials 7A, 7B, . . . are connected to each other to provide a connected long belt-loop material 7 having one or more connection portions 7*a* at a predetermined interval of distance. The connection portion or portions 7*a* has or have a width and a thickness which are greater than those of the respective remaining portions of the long materials 7A, 7B.

In FIG. 4, a slide pin 38 is fixed to a rear end portion of the vertical wall portion 33*c* of the first guide member 33, such that the slide pin 38 extends leftward through a hole formed through the thickness of the vertical wall portion 34*c* of the second guide member 34. Thus, respective positions of the two guide members 33, 34 in a direction parallel to the feeding direction F are aligned with each other. The support plate 32 has, at its front and rear ends, respective scales 39 which are used by an operator for accurately moving each of the two guide members 33, 34 relative to the guide groove 36 in a direction perpendicular to the feeding direction F.

Next, the feeding device 40 will be described by reference to FIGS. 3 to 5. The feeding device 40 includes a feeder roller 41 which has a plurality of teeth formed in its outer circumferential surface and which is aligned with a front end portion of the guide groove 36 for feeding the belt-loop material 7 being guided by the guide groove 36, to the cutting device 50, i.e., a cutting position where the cutting device 50 cuts the belt-loop material 7. The feeder roller 41 is coaxially fixed to a drive shaft 43 which is driven by a feeder-roller drive motor 42.

Figure 7:
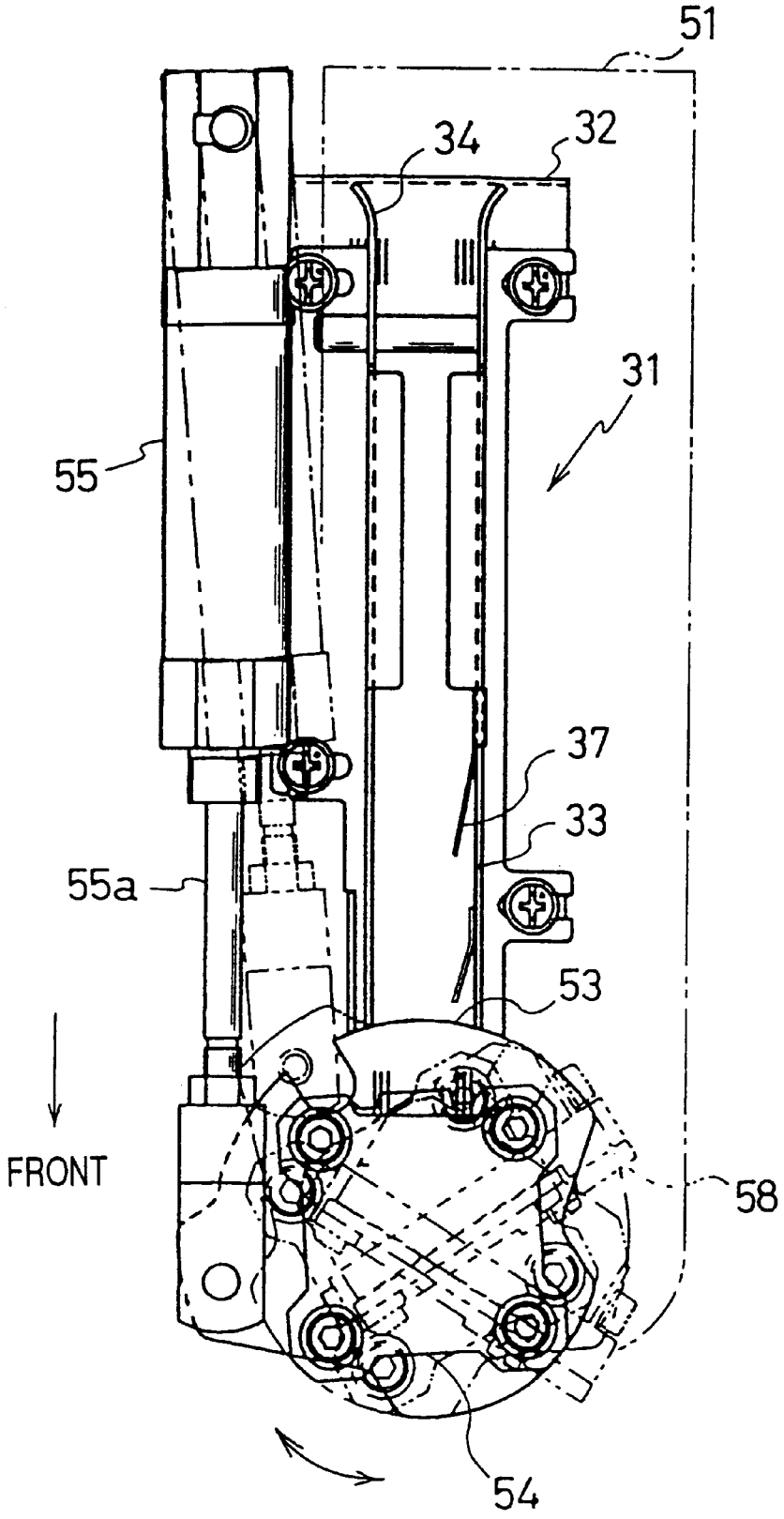
FIG. 7 is a plan view of the cutting device of FIG. 3.
Figure 8:
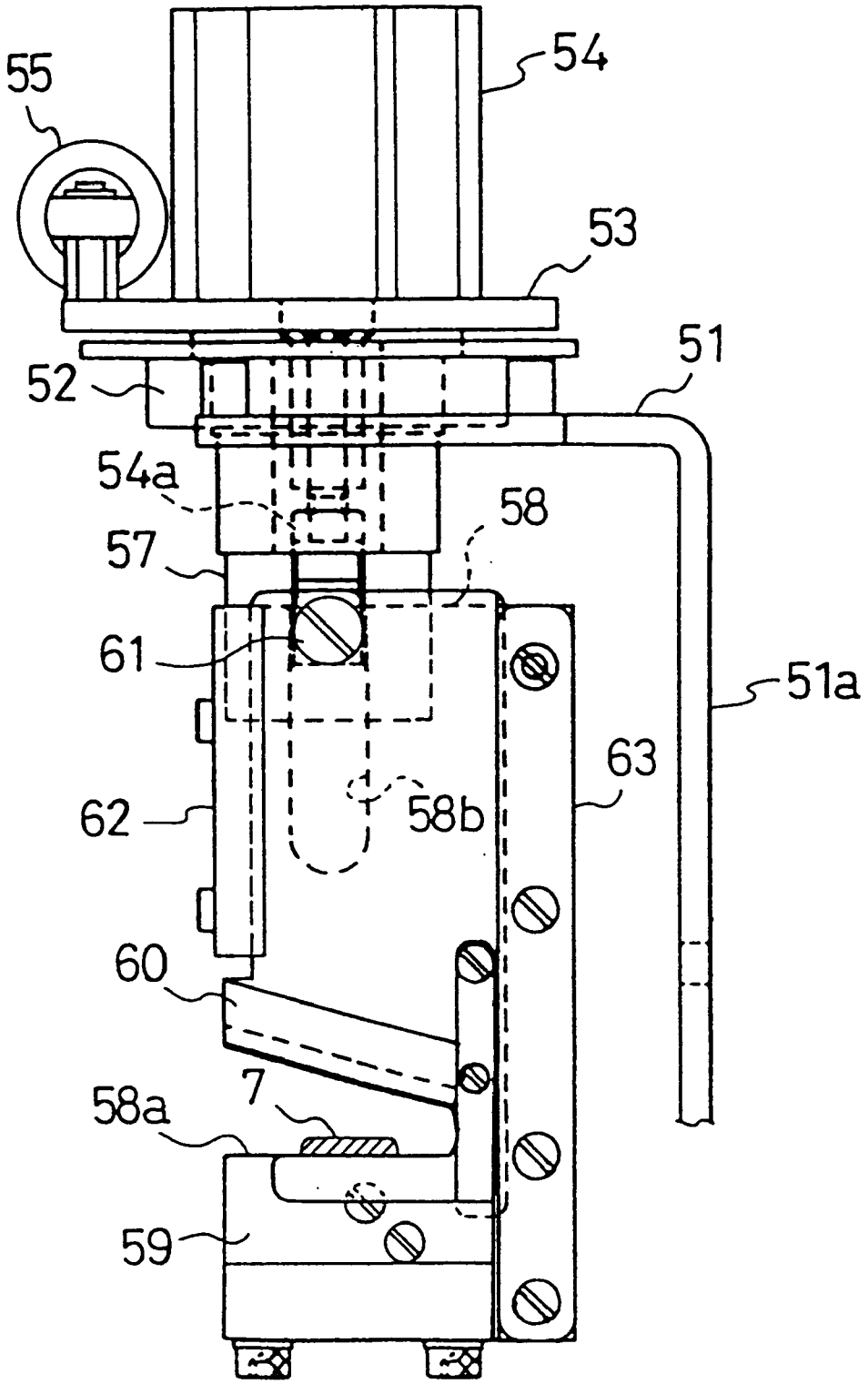
FIG. 8 is a front elevation view of the cutting device of FIG. 3.

Next, there will be described the cutting device 50 which cuts the belt-loop material 7 supplied from the BLM supplying apparatus 30, into a plurality of belt-loop pieces 8 each having a predetermined length, by reference to FIGS. 3, 7, and 8.

The cutting device 50 has a horizontal support plate 51 provided at a height position higher than that at which the BLM supplying apparatus 30 is provided. The support plate 51 includes a vertical wall portion 51*a* which extends downward from its right-hand end in FIG. 8. The support plate 51 is fixed to the table 5 via the vertical wall portion 51*a*. A horizontal bearing 52 is provided on the support plate 51, such that an outer ring of the bearing 52 is fixed to the support plate 51. A fitting portion of a rotatable plate 53 fits in an inner ring of the bearing 52. A cutting air-cylinder ("AC") device 54 is fixed to an upper surface of the rotatable plate 53, at a position corresponding to the front end portion of the guide groove 36, such that the cutting AC device 54 is oriented downward.

A rotating AC device 55 is pivotally supported, at its rear end portion, by a rear end portion of the support plate 51, such that the rotating AC device 55 extends in a direction parallel to the feeding direction F and such that the AC device 55 is pivotable in a horizontal plane. The AC device 55 has a piston rod 55*a* whose front end portion is pivotally connected to a left-hand end portion of the rotatable plate 53 in FIG. 8. When the rotating AC device 55 is operated to advance the piston rod 55*a* as shown in solid lines in FIG. 7, the rotatable plate 53 is rotated counterclockwise to a position indicated in solid lines; and when the AC device 55 is operated to retract the piston rod 55*a* as shown in broken lines, the rotatable plate 53 is rotated clockwise to a position indicated in broken lines.

A connection plate 57 which is an integral portion of the rotatable plate 52 extends downward from the rotatable plate 52. An upper end portion of a blade support plate 58 is fixed to the connection plate 57 which extends in a vertical direction. A fixed blade 59 is fixed to a recessed portion 58*a* of the blade support plate 58. In addition, an upper end portion of a movable blade 60 is fixed with a screw 61 to a lower end portion of a piston rod 54*a* of the cutting AC device 54. The movable blade 60 is vertically movable while being guided by two blade guides 62, 63 which are fixed to opposite end portions of the blade support plate 58, respectively, such that the blade guides 62, 63 vertically extend. The blade support plate 58 has an elongate slit 58*b* which permits the screw 61 to move up and down.

When the cutting AC device 54 is operated to advance the piston rod 54*a* downward, the movable blade 60 is moved downward while being guided by the two blade guide 62, 63. Thus, the movable blade 60 cooperates with the fixed blade 59 to cut off a predetermined length of the belt-loop material 7 which has been supplied to the recess 58*a*. Subsequently, when the rotating AC device 55 is operated to move the piston rod 55*a* from its advanced position to its retracted position, the blade support plate 58 supporting the movable and fixed blades 60, 59 is rotated by about 65 degrees. Thus, the cutting device 50 performs a first cutting operation when the piston rod 55*a* of the rotating AC device 55 takes its advanced position indicated in solid lines in FIG. 4, and then a second cutting operation when the piston rod 55*a* of the AC device 55 takes its retracted position indicated in broken lines. Thus, the belt-loop piece 8 has two V-shaped cut ends, and the remaining belt-loop material 7 has a V-shaped cut end.

Next, a control device 70 which controls the BLM supplying apparatus 30 and the cutting device 50 will be briefly described by reference to FIG. 9.

The control device 70 is provided as part of a control unit 25 of the BLP supplying device 10, and includes an air-cylinder control section 71 and a feeder- roller control section 72.

When the feeder-roller control section 72 receives a supply-start signal, SS, supplied from the control unit 25, the control section 72 drives the feeder-roller drive motor 42 to rotate the feeder roller 42 by a predetermined amount or angle, and supplies a material-cut signal, CS, to the air-cylinder control section 71.

In response to the material-cut signal CS supplied from the feeder-roller control section 72, the air-cylinder control section 71 drives respective control valves 73, 74 which supply a pressurized air from an air supply device 75, to the cutting AC device 54 and the rotating AC device 55, respectively. Thus, the cutting device 50 carries out the first and second cutting operations.

A cutting section provided by the movable and fixed blades 60, 59 is provided adjacent to, and on a downstream side of, the guide groove 36 in the feeding direction F in which the belt-loop material 7 is fed by the feeding device 40.

Next, there will be described the operation of the BLM supplying apparatus 30 constructed as described above.

Figure 10:
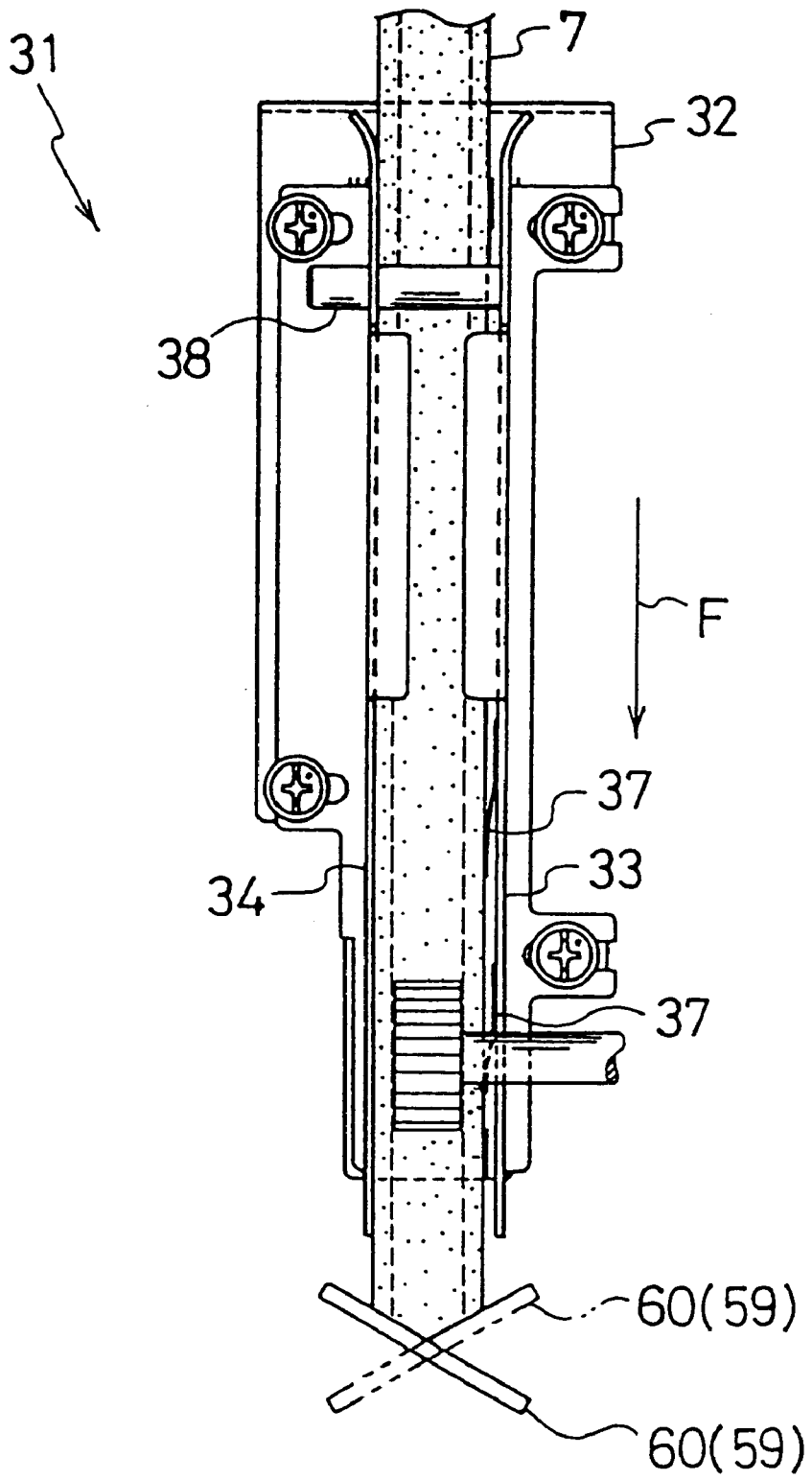
FIG. 10 is a plan view showing the BLM supplying device of FIG. 3 in a state in which the supplying device supplies a useful portion of the belt-loop material other than its connection portion.

As shown in FIG. 10, the belt-loop material 7 delivered from the BLM storing device (not shown) is supplied by being guided by the guide groove 36 of the guide device 31. When the belt-loop material 7 is fed toward the cutting device 50 in the feeding direction F by the feeding device 40, the two spring members 37 fixed to the vertical wall portion 33*c* of the first guide member 33 elastically bias, in the direction of width of the connected belt-loop material 7, each of the remaining portions 7*b* of the belt-loop material 7 being fed in the guide groove 36, toward the vertical wall portion 34*c* of the second guide member 34, so that the each remaining portion 7*b* is held in contact with the inner surface of the vertical wall portion 34*c* of the second guide member 34. Thus, the accuracy with which the belt-loop material 7 is positioned relative to the cutting device 50 in the direction of width of the material 7 is improved. More specifically explained, each of the remaining portions 7*b* is accurately positioned relative to the cutting device 50. Since the movable and fixed blades 59, 60 can cut the belt-loop material 7 accurately positioned relative thereto, the belt-loop material 7 can be cut into a plurality of belt-loop pieces 8 whose ends have the same V shape. That is, all the belt-loop pieces 8 have uniform V-shaped ends.

Figure 11:
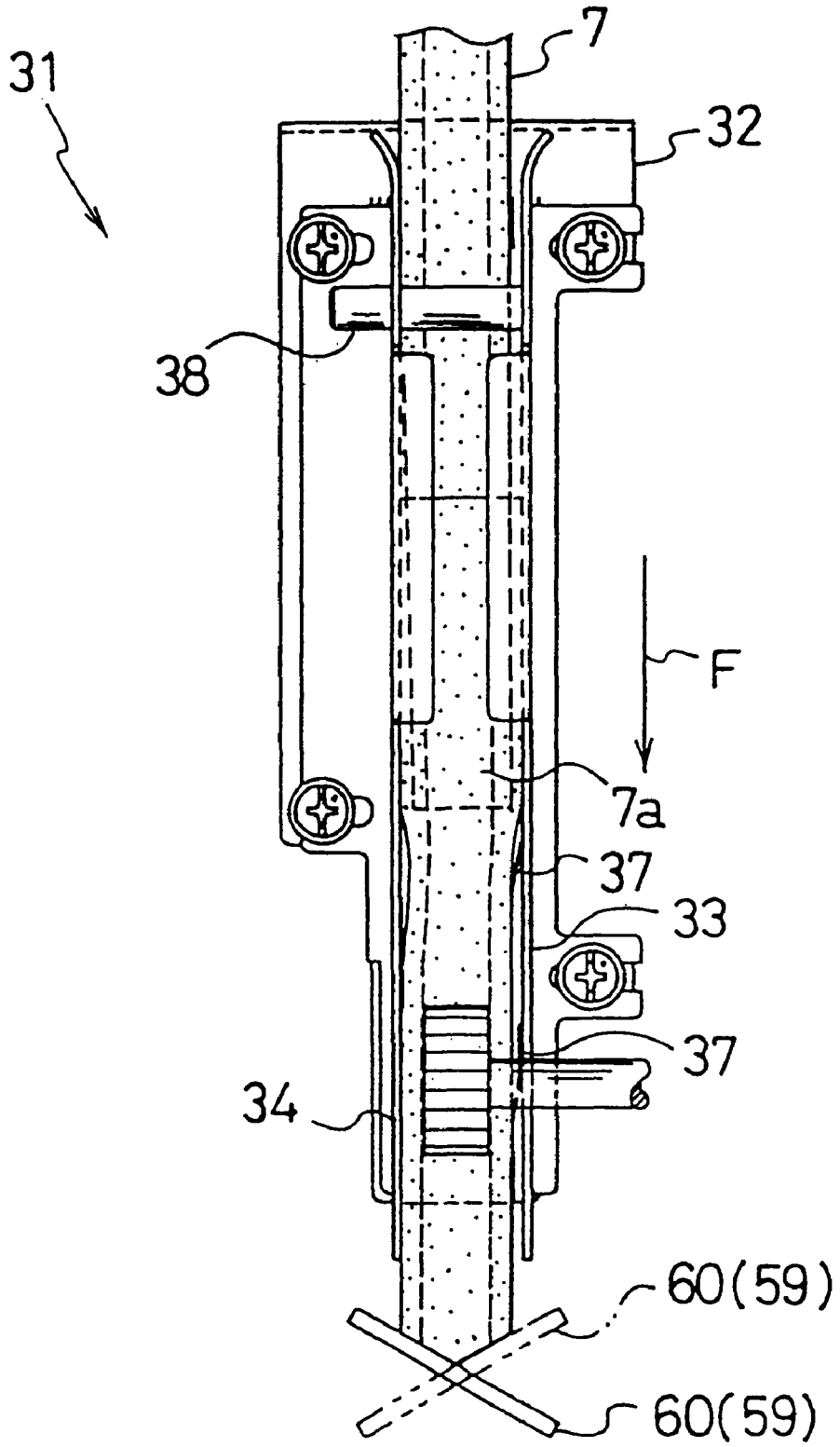
FIG. 11 is a plan view corresponding to FIG. 10, showing the BLM supplying device of FIG. 3 in a state in which the supplying device feeds the connection portion of the belt-loop material.

On the other hand, as shown in FIG. 11, when the connection portion 7*a* having a greater width is fed in the feeding direction F in the guide groove 36, the spring members 37 are elastically deformed by the connection portion 7*a*, so that the connection portion 7*a* is permitted to easily and smoothly pass through the guide groove 36. That is, the spring members 37 permit the connection portion 7*a* to pass through the guide device 30, without lowering the accuracy with which each remaining portion 7*b* is positioned relative to the cutting device 50 by the guide device 30. Thus, the guide device 30 functions as a positioning device which positions the connection portion 7*a* at a first predetermined position, and each remaining portion 7*b* at a second predetermined position different from the first position, in the direction of width of the material 7, because each remaining portion 7*b* is deformed by the biasing force of the spring members 37. In this embodiment, a center line of the connection portion 7*a* fed by the feeding device 40 is not aligned with, in the direction of width of the material 7, a center line of each remaining portion 7*b* positioned by the guide device 31, because the connection portion 7*a* is deformed relative to each remaining portion 7*b*. The respective center lines of the connection portion 7*a* and each remaining portion 7*b* are parallel to the feeding direction F.

Since each of the two guide members 33, 34 is movable relative to the support member 32, the distance between the two guide members 33, 34 is changeable by moving one or both of the guide members 33, 34, depending upon the width of the belt-loop material 7 being supplied from the BLM storing device.

Figure 12:
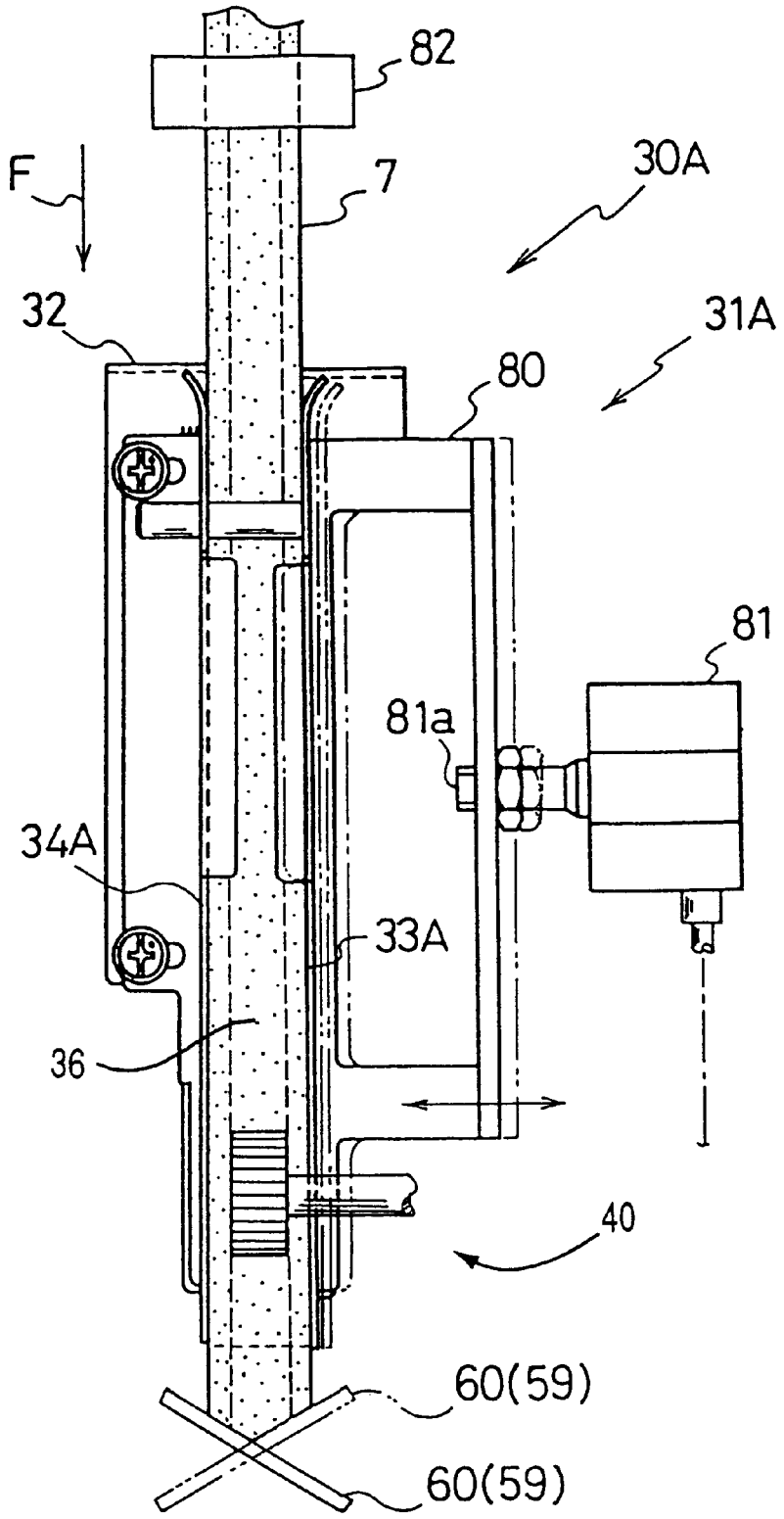
FIG. 12 is a view corresponding to FIG. 4, showing another BLM supplying device as a second embodiment of the present invention.

The BLM supplying apparatus 30 shown in FIG. 4 may be replaced by a modified BLM supplying apparatus 30A shown in FIG. 12.

The modified BLM supplying apparatus 30A employs a guide device 31A which includes a first guide member 33A different from the first guide member 33 of the BLM supplying apparatus 30; and a second guide member 34A similar to the second guide member 34 of the same 30. A connection frame member 80 having a generally rectangular shape is fixed to the first guide member 33A, and a piston rod 81*a* of a moving AC device 81 is connected to one side of the frame member 80. The moving AC device 81 moves the first guide member 33A in the direction of width of the connected belt-loop material 7, that is, in a direction perpendicular to the feeding direction F in which the belt-loop material 7 is fed by the feeding device 40.

The guide device 30A additionally includes a connection-portion sensor 82 which is provided on an upstream side of the guide groove 36 in the feeding direction F and which detects a thickness of each of the connection portion 7*a* and the remaining portions 7*b* of the connected belt-loop material 7, and supplies a detection signal, TS, (FIG. 9) indicative of the detected thickness, to the air-cylinder ("AC") control section 71 of the control device 70. Since the connection portion 7*a* has a thickness greater than each remaining portion 7*b*, the sensor 82 can detect the connection portion 7*a*. The sensor 82 includes a pivotable member, a biasing member which biases the pivotable member toward the bottom of the guide groove 36 and which permits the pivotable member to be pivoted back; and a sensing element which detects a position of the pivotable member and supplies a detection signal indicative of the detected position, to the AC control section 71. The AC control section 71 also receives a width-change signal, WCS, indicative of a width of the guide groove 36 which corresponds to a width of the remaining portions 7*b* of the belt-loop material 7 in use. The signal WCS may be provided by a detection signal indicative of the width of the remaining portions 7*b* which is detected by a material-width sensor (not shown) which will be described later in connection with the embodiment shown in FIG. 18. Except a predetermined time duration after the connection portion 7*a* has been detected by the sensor 82, the AC control section 7*a* controls a control valve 83 to supply, to the moving AC device 81, a pressurized air having a pressure corresponding to the width-change signal WCS. More specifically, the pressurized air supplied from the air supply device 75 is controlled to have the pressure corresponding to the signal WCS, and the pressure-controlled air is supplied to the moving AC device 81. Thus, the first guide member 33A is parallel-translated relative to the second guide member 34A till the distance between the two guide members 33A, 34A, that is, the width of the guide groove 36 becomes equal to the width of the belt-loop material 7.

In the present, second embodiment, each of the remaining portions 7*b* of the belt-loop material 7 is fed toward the cutting device 50 while being guided by the two guide members 33A, 34A, that is, while being held in contact with the respective inner surfaces of the guide members 33A, 34A. Thus, each remaining portion 7*b* is accurately positioned relative to the cutting device 50 in the direction of width of the material 7. Therefore, the cutting device 50 can cut the belt-loop material 7 into a plurality of belt-loop pieces 8 whose ends have the same V shape. Thus, the shape of cut ends of the belt-loop pieces 8 is stabilized.

Meanwhile, when the connection-portion sensor 82 detects the connection portion 7*a*, the AC control section 71 commands the control valve 83 to stop supplying the pressurize air to the moving AC device 81. Consequently, a coil spring (not shown) provided inside the AC device 81 moves the piston rod 81*a* back into a housing of the AC device 81, so that the first guide member 33A is retracted to its retracted position indicated in two-dot chain lines in FIG. 12, that is, is parallel-translated to increase the width of the guide groove 36. Thus, the connection portion 7*a* is permitted to easily and smoothly pass through the guide groove 36. In this embodiment, the center line of the connection portion 7*a* fed by the feeding device 40 is not aligned with, in the direction of width of the material 7, the center line of each remaining portion 7*b* positioned by the guide device 31A, because the connection portion 7*a* is deformed relative to each remaining portion 7*b*. However, the connection portion 7*a* is not positioned relative to the cutting device 50 in the direction of width of the material 7, because the first guide member 33A held at its retracted position cannot contact the connection portion 7*a*.

Figure 9:
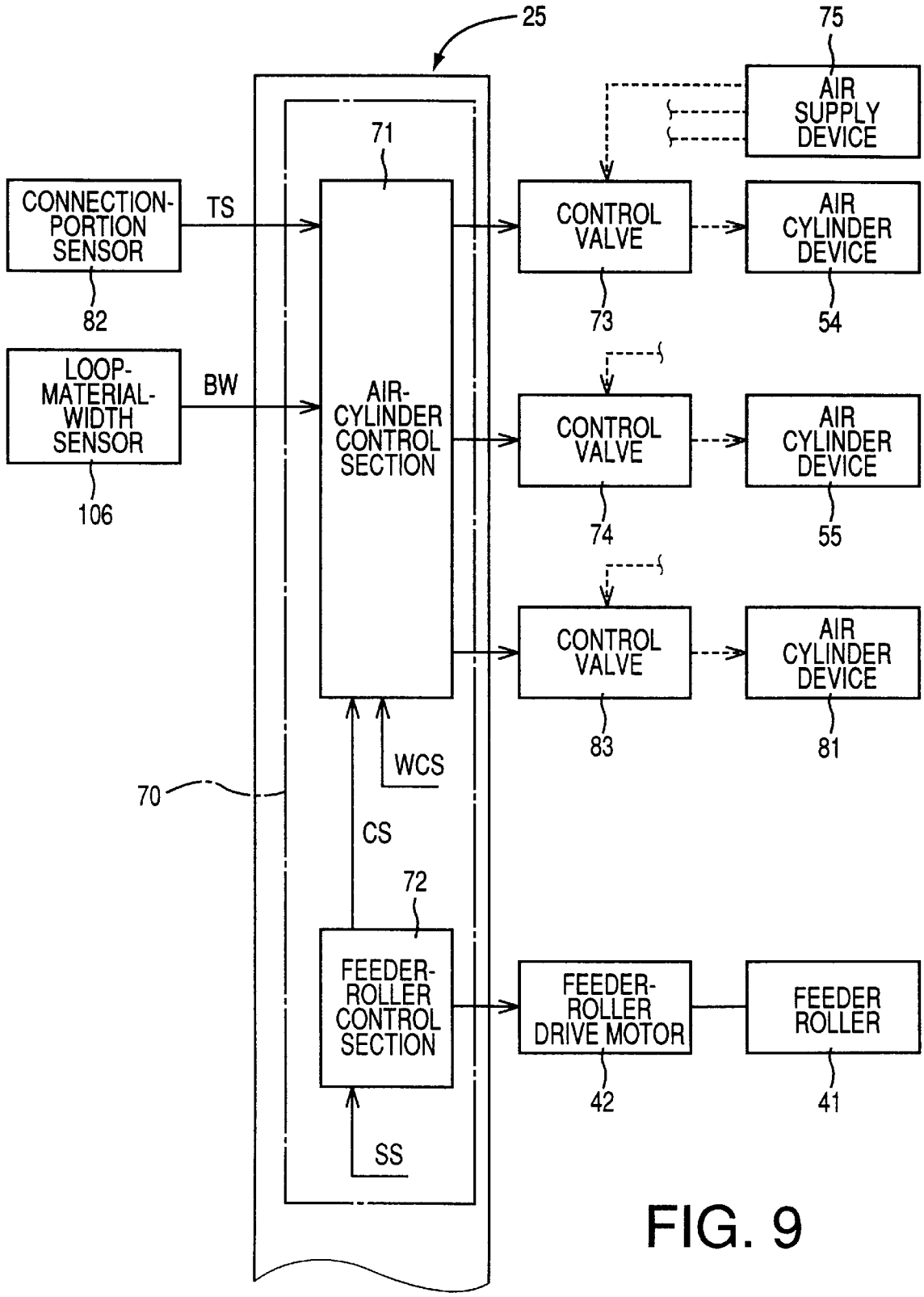
FIG. 9 is a block diagram representing a control system of the BLM supplying device of FIG. 3.

In each of the first embodiment shown in FIGS. 1 to 11 and the second embodiment shown in FIGS. 12 and 9, the cutting device 50 may be replaced by one which includes a movable and a fixed blade each of which has a V shape in its plan view and which cooperate with each other to cut, from the belt-loop material 8, a belt-loop piece 8 having a V-shaped cut end, in one cutting operation. One or each of the rotating AC device 55 and the cutting AC device 54 may be replaced by an electric actuator such as a solenoid device. In the first embodiment, in particular, the two spring members 37 employed as the biasing device which elastically biases the belt-loop material 7 toward the second guide member 34 may be replaced by a biasing device which directly blows air against the belt-loop material 7 and thereby holds the material 7 in contact with the inner surface of the second guide member 34.

In the second embodiment, it is possible that not only the first guide member 33A be moved by the moving AC device 81 but also the second guide member 34A be moved by another air-cylinder device. In this case, the width of the guide groove 36 can be changed by simultaneously moving the two guide members 33A, 34A, so that the changed width is equal to the width of the belt-loop material 7. The AC device 81 may be replaced by a stepper motor or a linear solenoid device that can control the position of the guide member 33A.

Figure 13:
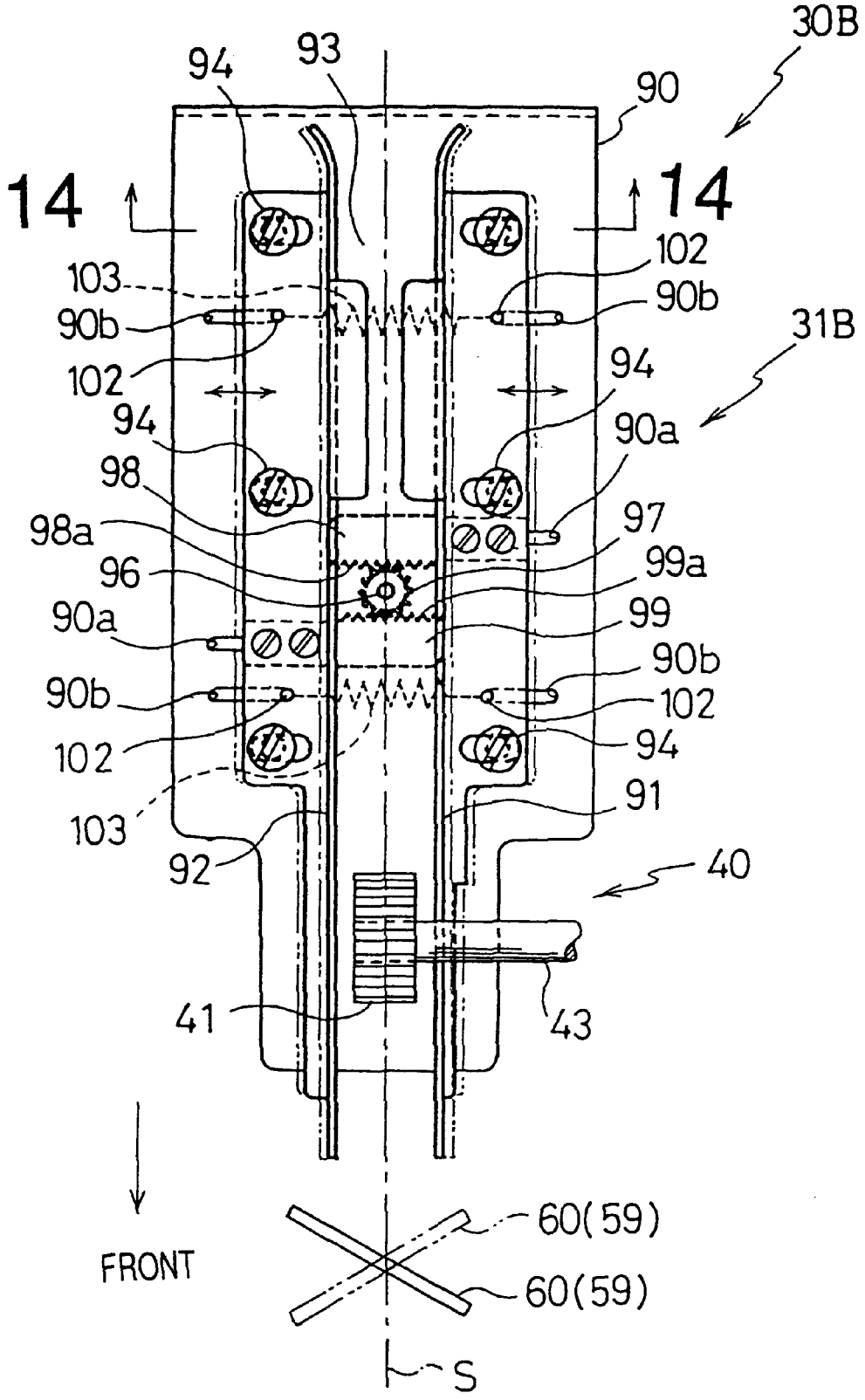
FIG. 13 is a view corresponding to FIG. 4, showing yet another BLM supplying device as a third embodiment of the present invention.

The BLM supplying apparatus 30 shown in FIG. 4 may be replaced by a modified BLM supplying apparatus 30B shown in FIG. 13.

The modified BLM supplying apparatus 30B employs a guide device 31B which has a guide groove 93 for guiding the connected belt-loop material 7; an interlock device 95; a tensile coil spring 103 which elastically biases a first and a second guide member 91, 92; and the feeding device 40 which feeds the belt-loop material 7 being guided through the guide groove 93, toward the cutting device 50 in the feeding direction F. Since not only the feeding device 40 but also the BLP supplying device 10 and the cutting device 50 are the same as those employed in the sewing system 1 shown in FIG. 1, the description of those devices 40, 10, 50 is omitted.

First, the guide device 31B will be described. The guide device 31B includes a horizontal support plate 90; and a first guide member 91 including a vertical wall portion extending parallel to the feeding direction F; a second guide member 92 including a vertical wall portion extending parallel to the feeding direction F. The support plate 90 supports the two guide members 91, 92 such that the respective vertical wall portions of the two guide members 91, 92 are parallel to each other and are opposed to each other in a direction perpendicular to the feeding direction. The two guide members 91, 92 are provided by two separate members, respectively. Each of the two guide members 91, 92 is attached to the support plate 90 with the help of three stepped screws 94, such that each guide member 91, 92 is movable in the direction perpendicular to the feeding direction F. Thus, the width of the guide groove 93 is changeable by the movement of the two guide members 91, 92.

Figure 14:
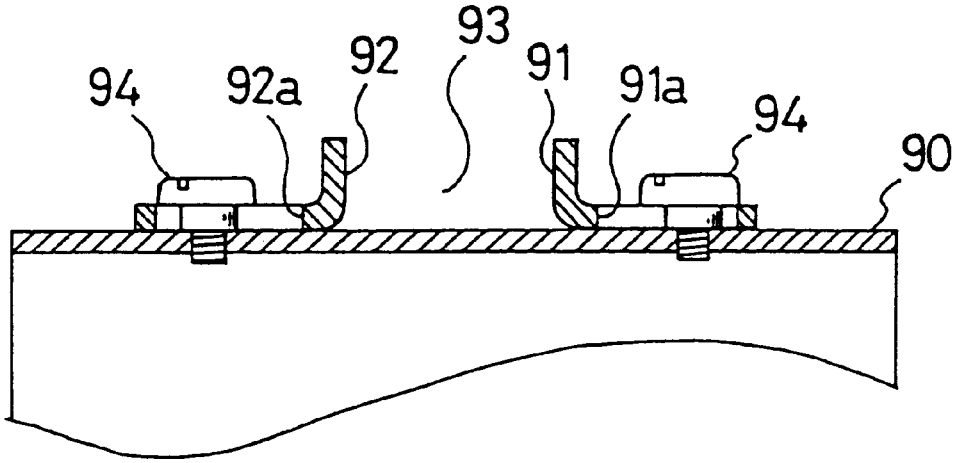
FIG. 14 is a cross-sectional, front elevation view taken along line 14—14 in FIG. 13.

More specifically described, as shown in FIG. 14, the first guide member 91 has three elongate guide holes 91*a* which are elongate in the direction perpendicular to the feeding direction F, and the second guide member 91 has three elongate guide holes 92*a* which are elongate in the same direction. Each guide member 91, 92 is movable relative to the support plate 90 by the movement of the guide holes 91*a*, 92*a* relative to the screws 94.

The support bottom plate 90 and the two guide members 91, 92 cooperate with one another to provide the guide groove 93 which linearly guides a predetermined length of a front end portion of the connected belt-loop material 7, toward the cutting device 50.

Figure 15:
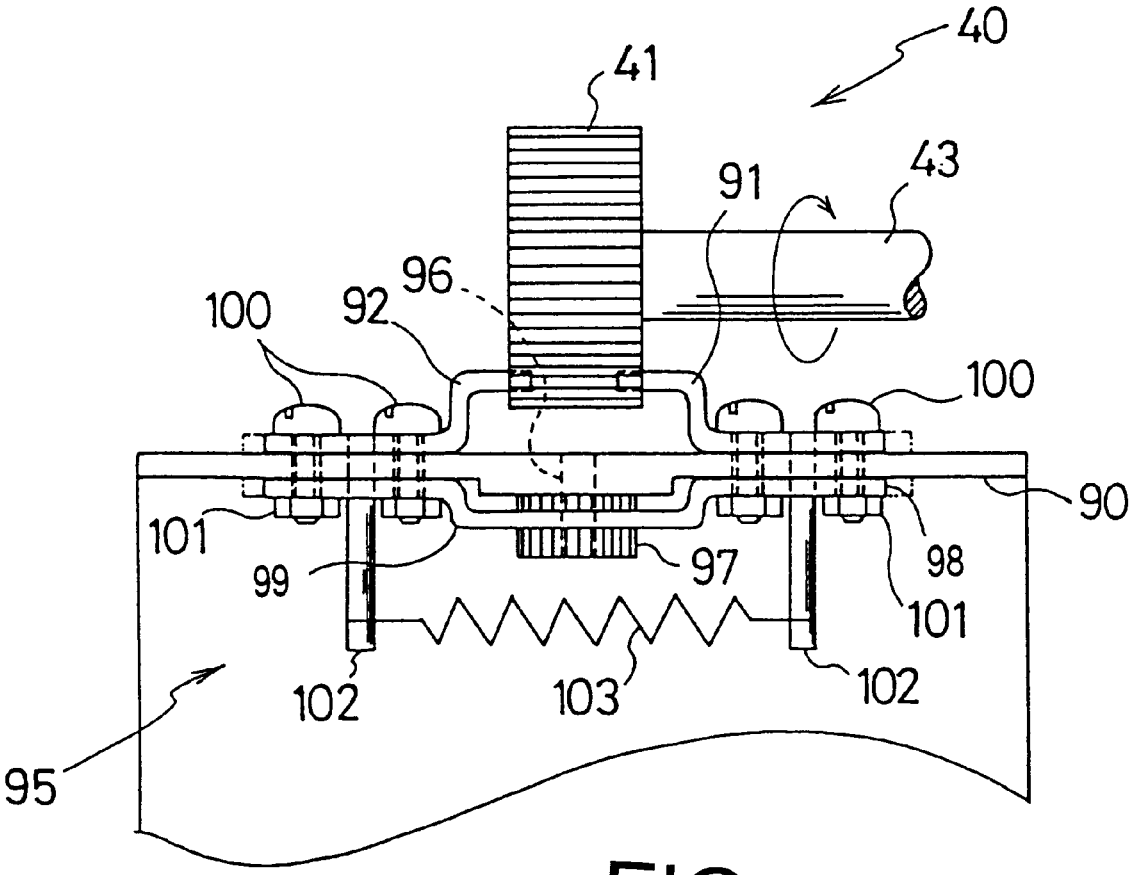
FIG. 15 is a front elevation view of the BLM supplying device of FIG. 13.

Next, the interlock device 95 will be described by reference to FIGS. 13 and 15. The interlock device 95 interlocks the first and second guide members 91, 92, and moves the two guide members toward, and away from, each other symmetrically with respect to a center line, S, of the guide groove 93.

A central portion of the support plate 90 in the direction perpendicular to the feeding direction F, i.e., in a widthwise direction of the guide groove 93, supports an axis pin 96 which supports a pinion 97 such that the pinion 97 is rotatable in a horizontal plane. The pinion 97 is meshed with teeth 98*a* of a first rack member 98 and teeth 99*a* of a second rack member 99. The first and second rack members 98, 99 are provided on both sides of the pinion 97 such that the rack members 98, 99 extend in the widthwise direction of the guide groove 93, and are connected to the first and second guide members 91, 92, respectively, via screws 100 and nuts 101.

The support plate 90 has two elongate guide holes 90*a* which are elongate in the widthwise direction of the guide groove 93. The first guide member 91 and the first rack member 98 are connected to each other by the two nuts 101 and the two screws 100 passing through respective cylindrical spacers (not shown) provided in one of the two guide holes 90*a*. Similarly, the second guide member 92 and the second rack member 99 are connected to each other by the two nuts 101 and the two screws 100 passing through respective cylindrical spacers (not shown) provided in the other guide hole 90*a*.

Thus, if one of the two guide members 91, 92 is moved in one of opposite directions parallel to the widthwise direction of the guide groove 93, the other guide member is also moved in the other direction and by the same distance, because of the engagement of the two rack members 98, 99 with the common pinion 97. Therefore, whenever the width of the guide groove 93 is increased or decreased by the movement of the two guide members 91, 92 in the widthwise direction, a first distance between the center line S of the guide groove 93, i.e., a center line, S, of the belt-loop material 7 and one of the two guide members 91, 92 is kept equal to a second distance between the center line S of the belt-loop material 7 and the other guide members 92, 91. Since the position of the cutting device 50 is aligned with the center line S in the widthwise direction of the guide groove 93, each of the connection portion 7*a* and the remaining portions 7*b* of the belt-loop material 7 is accurately positioned relative to the cutting device 50 in the widthwise direction of the guide groove 93. In this embodiment, the center line of the connection portion 7*a* is aligned with that of each remaining portion 7*b* in the widthwise direction of the guide groove 93, and the width of the guide groove 93 is automatically adjustable depending upon the width of each of the connection portion 7*a* and the remaining portions 7*b*.

The support plate 90 additionally has four elongate guide holes 90*b* which are elongate in the widthwise direction of the guide groove 93 and which are symmetrical with one another with respect to the center line S. Two of the four holes 90*b* are formed in a front half portion of the support plate 90, and the other two holes 90*b* are formed in a rear half portion of the support plate 90, and two of the four holes 90*b* are formed in a right half portion of the support plate 90, and the other two holes 90*b* are formed in a left half portion of the support plate 90. Two first engage pins 102 which vertically pass through the right-hand two guide holes 90*b*, respectively, are fixed, at their upper end portions, to the first guide member 91, and two second engage pins 102 which vertically pass through the left-hand two guide holes 90*b*, respectively, are fixed, at their upper end portions, to the second guide member 92. A first tensile coil spring 103 is connected, at their opposite end portions, to the two first engage pins 102, respectively, and a second tensile coil spring 103 is connected, at their opposite end portions, to the two second engage pins 102, respectively. Thus, the two coil springs 103 cooperate with each other to bias, via the interlock device 95, the two guide members 91, 92 toward each other, more specifically, to their innermost positions, shown in FIG. 13, corresponding to respective inner ends of the four guide holes 90*b* which define respective ranges within which the two guide members 91, 92 are permitted to move in the widthwise direction of the guide groove 93.

Next, there will be described the operation of the BLM supplying apparatus 30B constructed as described above.

Figure 16:
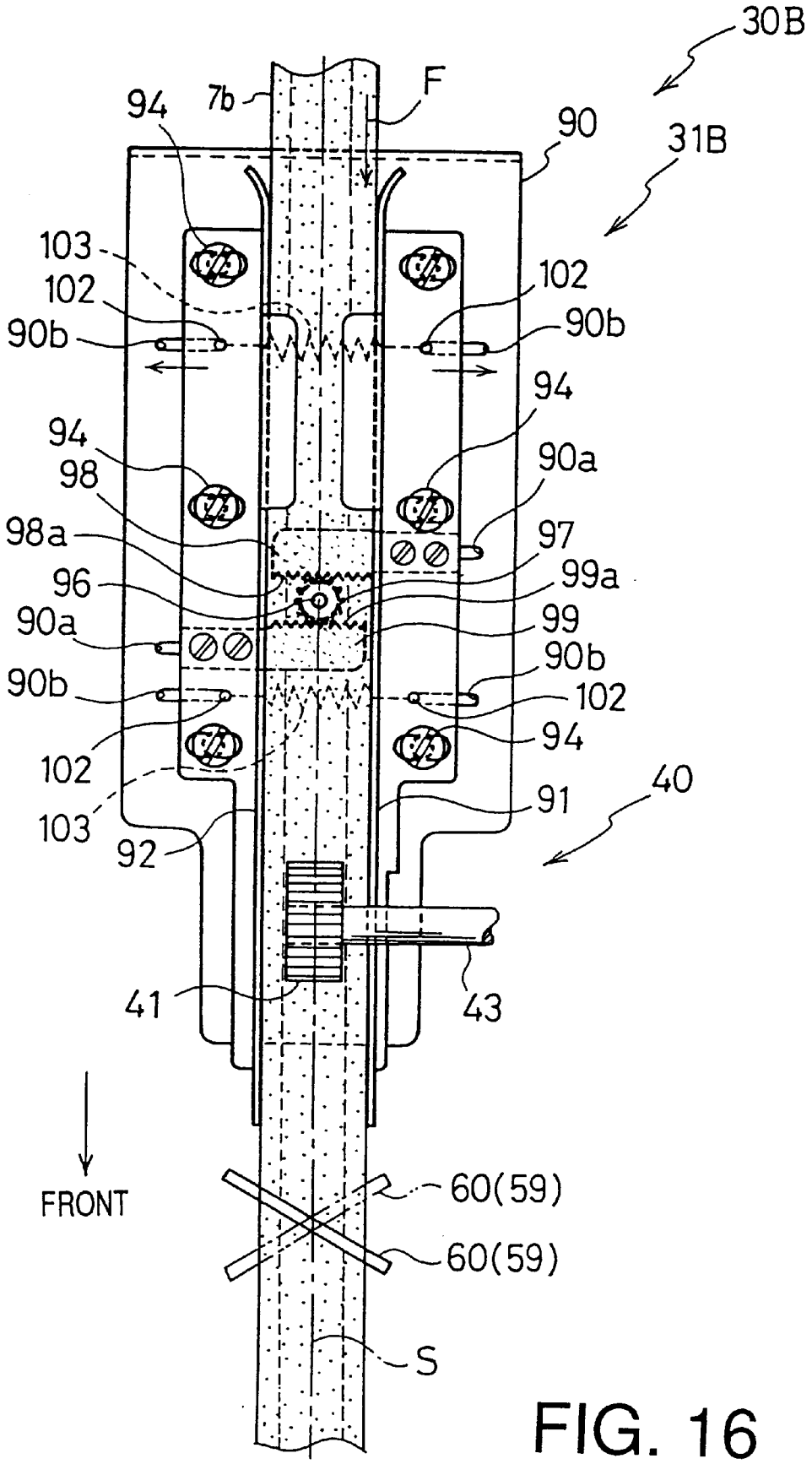
FIG. 16 is a plan view showing the BLM supplying device of FIG. 13 in a state in which the supplying device supplies a useful portion of a belt-loop material other than its connection portion.

As shown in FIG. 16, the belt-loop material 7 delivered from the BLM storing device (not shown) is fed in the feeding direction F while being guided by the guide groove 93 of the guide device 31B. In the case where the width of the belt-loop material 7 is greater than the minimum width of the guide groove 93 corresponding to the inner ends of the guide holes 90*b* and smaller than the maximum width of the guide groove 93 corresponding to the outer ends of the guide holes 90*b*, the width of the guide groove 93 is automatically increased or decreased to be equal to the width of each of the connection portion 7*a* and the remaining portions 7*b* of the belt-loop material 7, against the biasing forces of the coil springs 103.

Owing to the interlock device 95, the two guide members 91, 92 are moved toward, or away from, each other symmetrically with respect to the center line S of the guide groove 93. Therefore, whenever the width of the guide groove 93 is increased or decreased, the center line of each of the remaining portions 7*b* of the belt-loop material 7 is kept aligned with the center line S of the guide groove 93.

Figure 17:
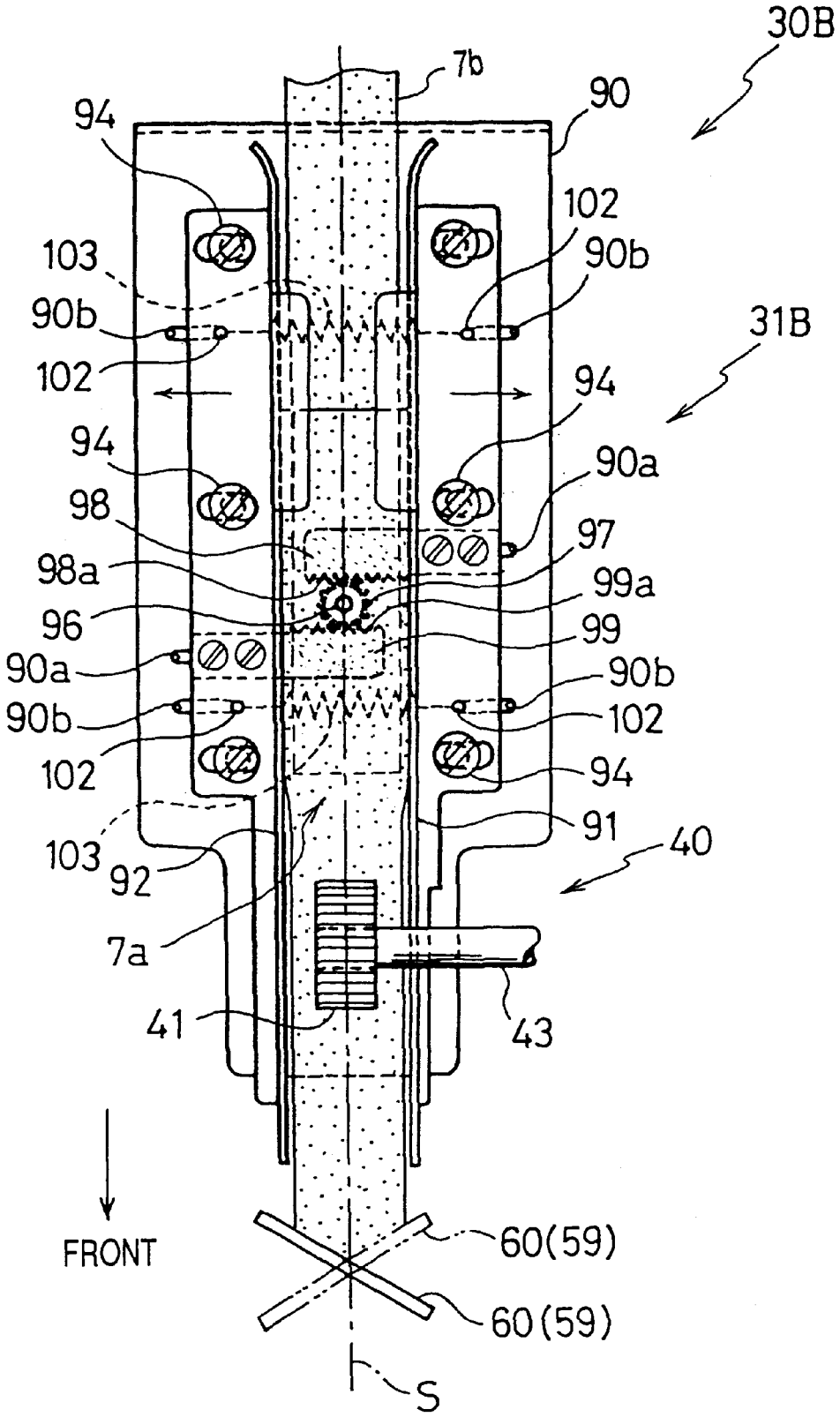
FIG. 17 is a plan view corresponding to FIG. 16, showing the BLM supplying device of FIG. 13 in a state in which the supplying device feeds the connection portion of the belt-loop material.

When, as shown in FIG. 17, the connection portion 7*a* of the belt-loop material 7 that has the greater width than that of each remaining portion 7*b* passes through the guide groove 93, similarly the two guide members 91, 92 are simultaneously moved outward, away from each other, against the biasing forces of the coil springs 103. Thus, the width of the guide groove 93 is temporarily increased, so that the connection portion 7*a* is permitted to easily and smoothly pass through the guide groove 93. The center line of the connection portion 7*a* is also kept aligned with the center line S of the guide groove 93.

Since the interlock device 95 is provided by the two rack members 98, 99 fixed to the two guide members 91, 92, and the rotatable pinion 97 meshed with the rack members 98, 99, the interlock device 95 enjoys a simple construction.

Figure 18:
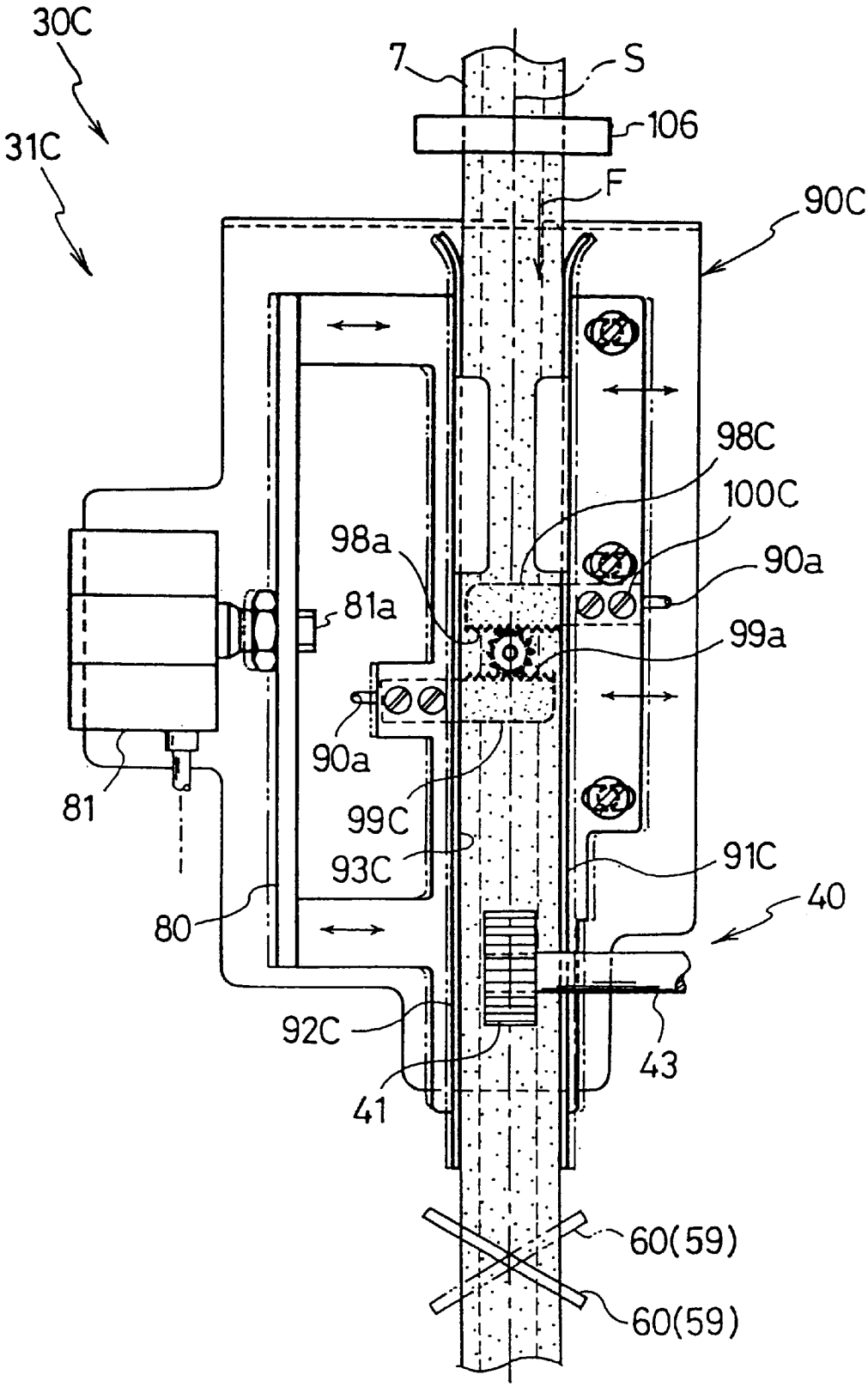
FIG. 18 is a view corresponding to FIG. 4, showing another BLM supplying device as a fourth embodiment of the present invention.
Figure 19:
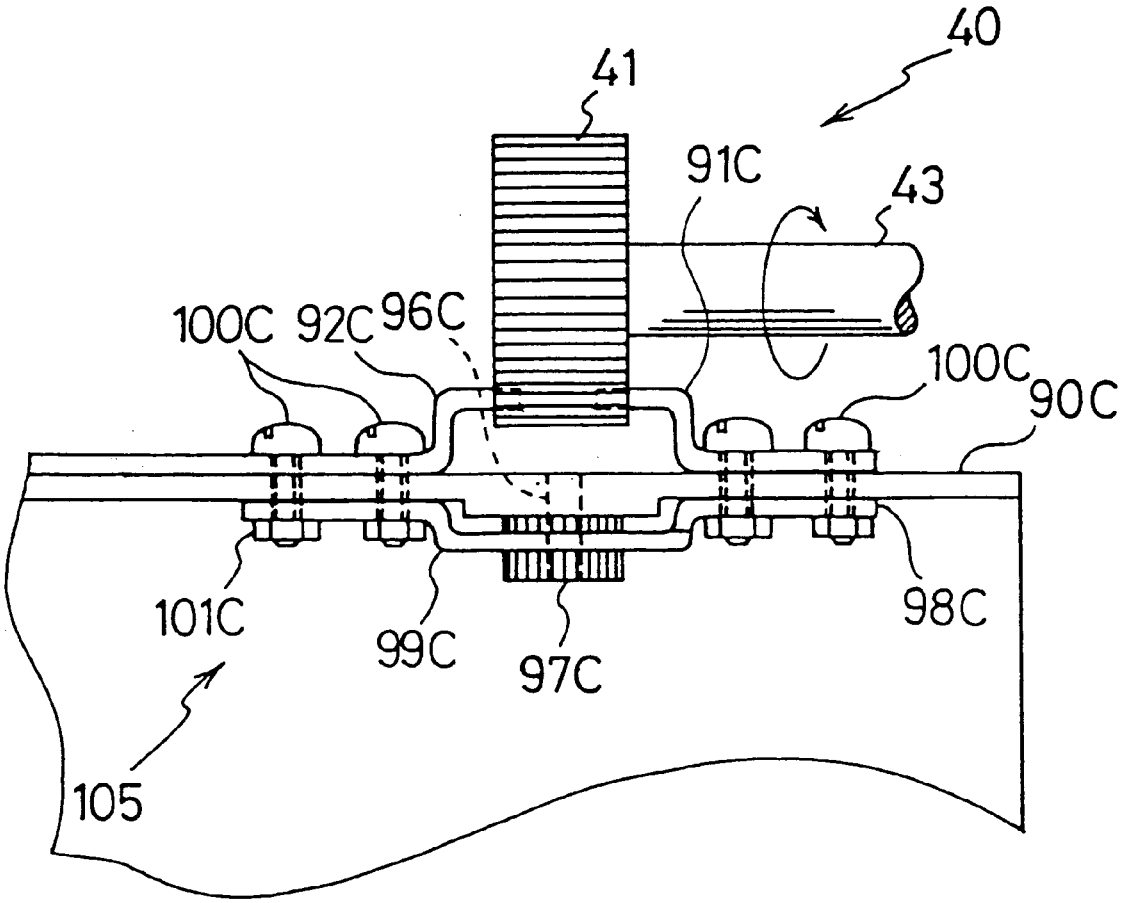
FIG. 19 is a front elevation view of the BLM supplying device of FIG. 18.

The BLM supplying apparatus 30 shown in FIG. 4 may be replaced by a modified BLM supplying apparatus 30C shown in FIGS. 18 and 19.

The modified BLM supplying apparatus 30C employs a guide device 31C which has a guide groove 93C for guiding the connected belt-loop material 7; an interlock device 105; and the feeding device 40 which feeds the belt-loop material 7 being guided through the guide groove 93C, toward the cutting device 50 in the feeding direction F. Since not only the feeding device 40 but also the BLP supplying device 10 and the cutting device 50 are the same as those employed in the sewing system 1 shown in FIG. 1, the description of those devices 40, 10, 50 is omitted.

First, the guide device 31C will be described. The guide device 31C includes a first guide member 91C similar to the first guide member 91 of the BLM supplying apparatus 30B shown in FIG. 13; and a second guide member 92C different from the second guide member 92 of the same 30B. The generally rectangular connection frame member 80 is fixed to the second guide member 92C, and the piston rod 81*a* of the moving AC device 81 is connected to one side of the frame member 80. The moving AC device 81 moves the second guide member 92C in the direction of width of the connected belt-loop material 7, that is, in the widthwise direction of the guide groove 93C.

Next, the interlock device 105 will be described. Since, however, the interlock device 105 has a construction basically similar to that of the interlock device 95 shown in FIG. 13, the device 105 will be described briefly by reference to FIG. 19. A support plate 90C supports an axis pin 96C which supports a pinion 97C such that the pinion 97C is rotatable in a horizontal plane. The pinion 97C is meshed with teeth 98*a* of a first rack member 98C and teeth 99*a* of a second rack member 99C. The first and second rack members 98C, 99C are provided on a rear and a front side of the pinion 97C, respectively, and are connected to the first and second guide members 91C, 92C, respectively, via screws 100C and nuts 101C.

The support plate 90C has two elongate guide holes 90*a*. The first guide member 91C and the first rack member 98C are connected to each other by the two nuts 101C and the two screws 100C passing through respective cylindrical spacers (not shown) provided in one of the two guide holes 90*a*. Similarly, the second guide member 92C and the second rack member 99C are connected to each other by the two nuts 101C and the two screws 100C passing through respective cylindrical spacers (not shown) provided in the other guide hole 90*a*.

When the moving AC device 81 is operated to move the second guide member 92C in one of opposite directions parallel to the widthwise direction of the guide groove 93C, the first guide member 91C is simultaneously moved in the other direction and by the same distance, owing to the interlock device 105. Therefore, whenever the width of the guide groove 93C is increased or decreased by the movement of the two guide members 91C, 92C in the widthwise direction, a first distance between the center line S of the guide groove 93C, i.e., the center line S of the belt-loop material 7 and the first guide member 91C is kept equal to a second distance between the center line S of the belt-loop material 7 and the second guide members 92C. Since the position of the cutting device 50 is aligned with the center line S in the widthwise direction of the guide groove 93C, each of the connection portion 7*a* and the remaining portions 7*b* of the belt-loop material 7 is accurately positioned relative to the cutting device 50 in the widthwise direction of the guide groove 93C. In this embodiment, too, the center line of the connection portion 7*a* is aligned with that of each remaining portion 7*b* in the widthwise direction of the guide groove 93.

As shown in FIG. 18, the guide device 31C additionally includes a material-width sensor 106 which is provided on an upstream side of the guide groove 93C in the feeding direction F and which detects a width of each of the connection portion 7*a* and the remaining portions 7*b* of the connected belt-loop material 7, and supplies a detection signal, BW, (FIG. 9) indicative of the detected width, to the AC control section 71 of the control device 70. The sensor 106 includes an array of light emitters which extends in the widthwise direction of the guide groove 93C, and an array of light receives which extends in the same direction which is opposed to the array of light emitters via the belt-loop material 7 being fed. The number of the lights emitted by the light emitters but not received by the light receivers changes depending upon the width of each of the connection portion 7*a* and the remaining portions 7*b* of the belt-loop material 7. Thus, the sensor 106 can detect, based on the above number, each of the connection portion 7*a* and the remaining portions 7*b* of the belt-loop material 7. Thus, the sensor 106 is a transmission-type sensor. However, the transmission-type sensor 106 may be replaced by a reflection-type sensor. Since the connection portion 7*a* has the greater width than that of each remaining portion 7*b*, the sensor 106 can detect the connection portion 7*a*.

Based on the detection signal BW, the AC control section 71 controls the control valve 83 to supply, to the moving AC device 81, a pressurized air having a pressure corresponding to the detection signal BW. More specifically, the pressurized air supplied from the air supply device 75 is controlled to have the pressure corresponding to the detection signal BW, and the thus pressure-controlled air is supplied to the moving AC device 81. Thus, the second guide member 92C is moved in the widthwise direction of the guide groove 93C, and simultaneously the first guide member 91C is moved, owing to the interlock device 105, in a direction opposite to the direction in which the second guide member 92C is moved, and by the same distance as the distance by which the second guide member 92C is moved. Thus, the width of the guide groove 93C is automatically adjusted to be equal to the width of each of the connection portion 7*a* and the remaining portions 7*b* of the belt-loop material 7. In addition, the belt-loop material 7 is fed to the cutting device 50 while being guided by the guide groove 93C of the guide device 31C, in such a manner that the center line of each of the connection portion 7*a* and the remaining portions 7*b* is aligned with the center line S of the guide groove 93C. Thus, each of the connection portion 7*a* and the remaining portions 7*b* is accurately positioned relative to the cutting device 50 in the widthwise direction of the guide groove 93C, and accordingly the shape of the V-shaped cut ends of the belt-loop pieces 8 obtained from the belt-loop material 7 is stabilized.

When the sensor 106 detects the connection portion 7*a,* the AC control section 71 temporarily adjusts the width of the guide groove 93C to the width of the connection portion 7*a,* for a predetermined time duration which is needed for the connection portion 7*a* to be fed through the guide groove 93C by the feeding device 40.

Figure 20:
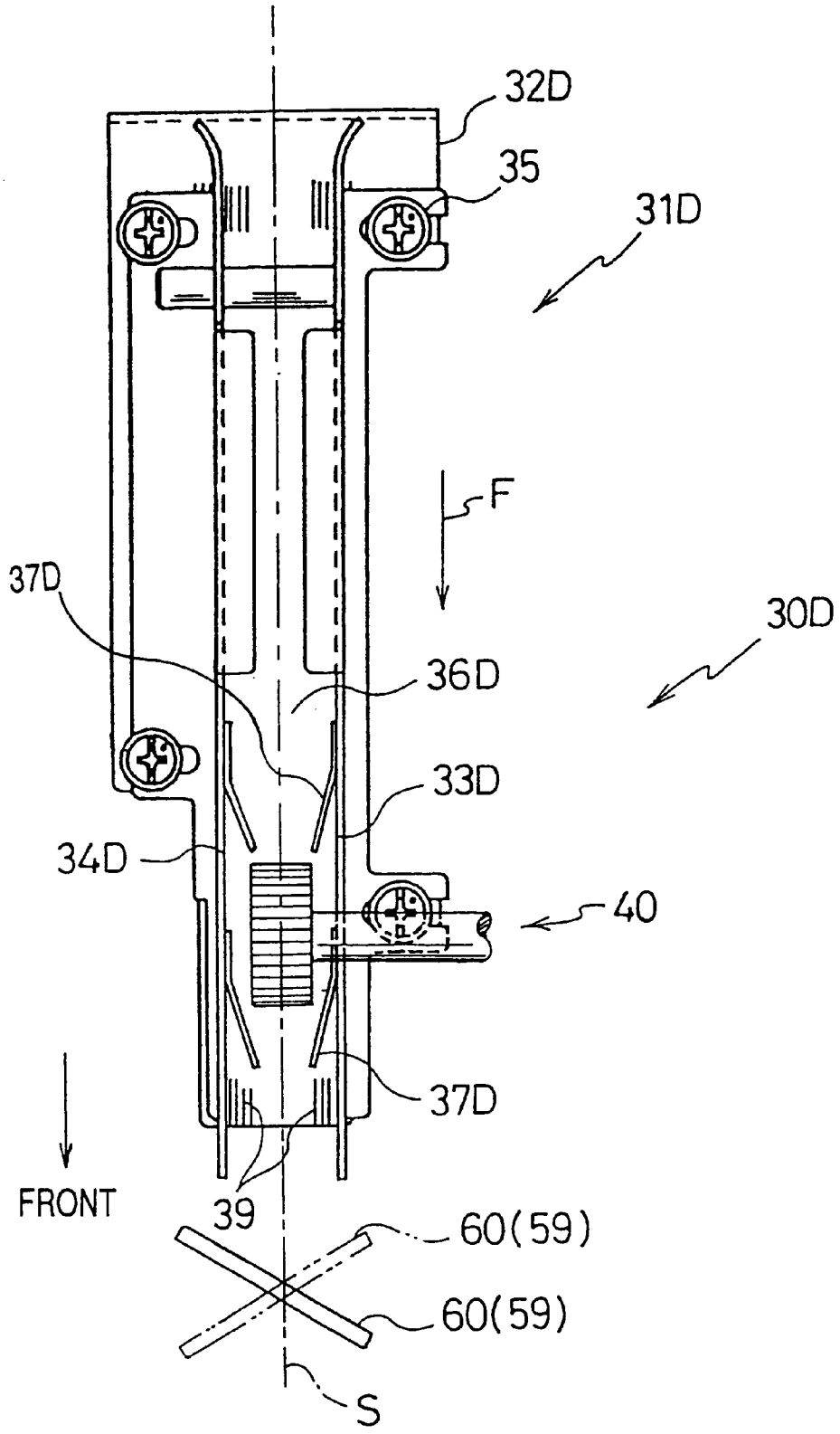
FIG. 20 is a view corresponding to FIG. 4, showing another BLM supplying device as a fifth embodiment of the present invention.
Figure 21:
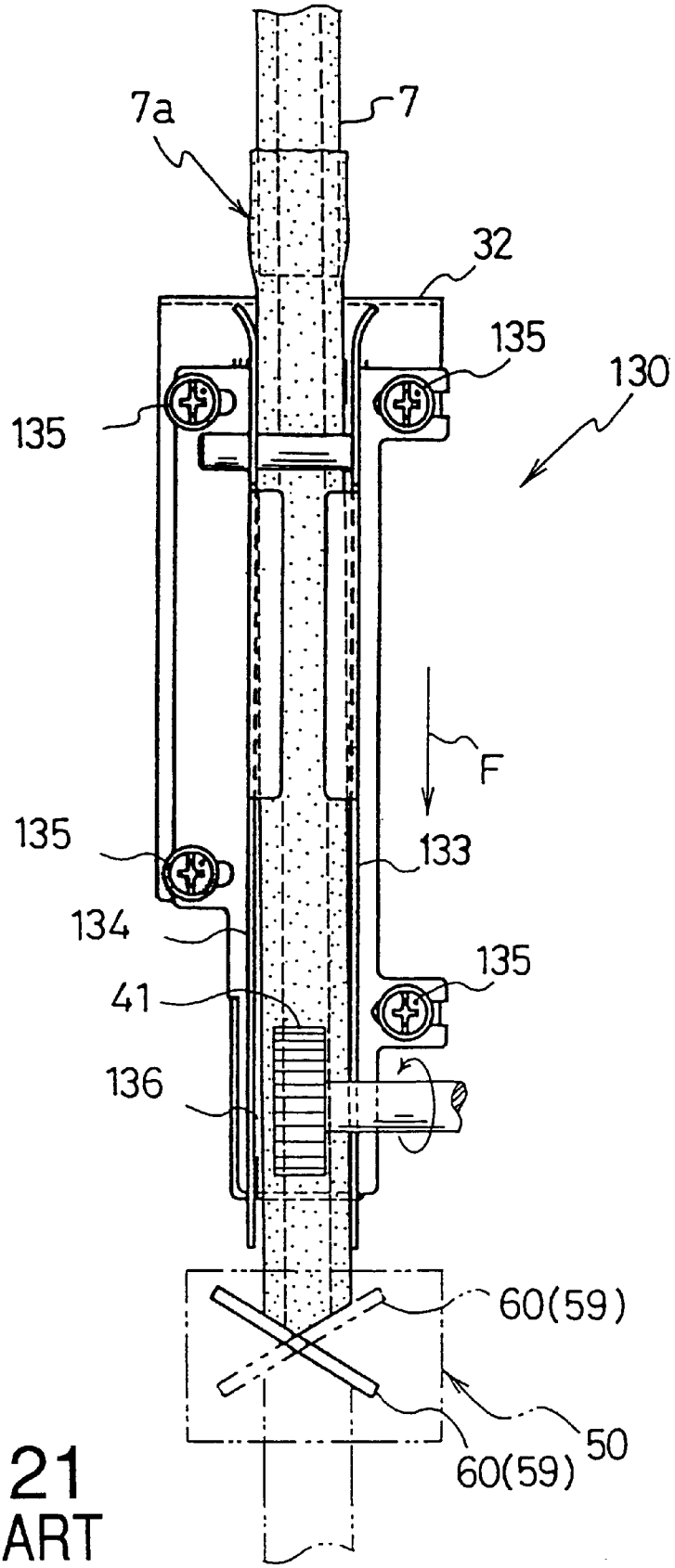
FIG. 21 PRIOR ART
FIG. 21 is a view corresponding to FIG. 4, showing a conventional BLM supplying device.

The BLM supplying apparatus 30 shown in FIG. 4 may be replaced by a modified BLM supplying apparatus 30D shown in FIG. 20.

The modified BLM supplying apparatus 30D employs a modified guide device 31D in place of the guide device 31 of the BLM supplying apparatus 30. The following description relates to only the differences between the modified guide device 31D and the guide device 31. Since not only the feeding device 40 but also the BLP supplying device 10 and the cutting device 50 are the same as those employed in the sewing system 1 shown in FIG. 1, the description of those devices 40, 10, 50 is omitted.

The BLM supplying apparatus 30D includes the guide device 31D having a guide groove 36D which guides the belt-loop material 7; four leaf-spring members 37D which elastically bias the belt-loop material 7; and the feeding device 40 which feeds the belt-loop material 7 being guided through the guide groove 36D, in the feeding direction F toward the cutting device 50.

A support plate 32D and a first and a second guide members 33D, 34D cooperate with one another to provide the guide groove 36D which linearly guides a predetermined length of a front end portion of the connected belt-loop material 7 including one or more connection portions 7*a* and two or more remaining portions 7*b*.

A pair of first elastically deformable leaf-spring members 37D are fixed, at their respective end portions, by welding, to an inner surface of a front portion of a vertical wall portion of the first guide member 33D, such that the respective end portions of the two spring members 37D are spaced from each other by a predetermined distance in a direction parallel to the feeding direction F. Similarly, a pair of second elastically deformable leaf-spring members 37D are fixed, at their respective end portions, by welding, to an inner surface of a front portion of a vertical wall portion of the second guide member 34D, such that the respective end portions of the two spring members 37D are spaced from each other by a predetermined distance in a direction parallel to the feeding direction F. The two first spring members 37D provide a first biasing device, and each first spring member 37D provides a first biasing member; and the two second spring members 37D provide a second biasing device, and each second spring member 37D provides a second biasing member When the belt-loop material 7 is fed by the feeding device 40, through the guide groove 36D, the two first spring members 37D on one side and the second spring members 37 D on the other side bias each of the connection portion 7*a* and the remaining portions 7*b* of the belt-loop material 7, in opposite directions parallel to the widthwise direction of the guide groove 36D, respectively, so that the center line of each of the connection portion 7*a* and the remaining portions 7*b* is aligned with the center line S of the guide groove 36D. Thus, each of the connection portion 7*a* and the remaining portions 7*b* is accurately positioned relative to the cutting device 50 in the widthwise direction of the guide groove 36D, and accordingly the shape of the V-shaped cut ends of the belt-loop pieces 8 obtained from the belt-loop material 7 is stabilized.

When the connection portion 7*a* having the greater width than that of each remaining portion 7*b* passes through the guide groove 36D, the four spring members 37D are elastically deformed so as to permit the connection portion 7*a* to pass therethrough. Thus, the connection portion 7*a* is easily and smoothly fed to the cutting device 50.

The BLM supplying apparatus 30, 30A, 30B, 30C, 30D may be modified with various changes, and may be used for supplying various sorts of belt-loop materials to a sewing system.

It is to be understood that the present invention may be embodied with other changes, improvements, and modifications that may occur to the person skilled in the art without departing from the scope and spirit of the invention defined in the appended claims.

What is claimed is:

1. An apparatus for supplying, to a sewing device, a connected belt-loop material including at least one connection portion where two long materials are connected to each other, the connection portion having, a width greater than a substantially constant width of a remaining portion of the belt-loop material, the apparatus comprising:

a feeding device which feeds the belt-loop material toward the sewing device;

a positioning device which positions, in a direction extending parallel to the width of the belt-loop material, the remaining portion of the belt-loop material being fed by the feeding device, so that the remaining portion takes a first reference position in said direction extending parallel to the width, wherein the positioning device comprises a connection-portion positioning device which permits the connection portion to be fed by the feeding device, while positioning the connection portion in said direction of width so that the connection portion takes a second reference position in the direction extending parallel to the width, wherein the connection-portion positioning device comprises a guide member which guides each of the connection portion and the remaining portion of the belt-loop material being fed by the feeding device, and a biasing device which biases said each of the connection portion and the remaining portion toward the guide member in said direction extending parallel to the width, and thereby positions the connection portion at the second reference position and the remaining portion at the first reference position different from the second reference position, wherein the biasing device comprises at least one leaf spring member which extends in an oblique direction having a first directional component toward the guide member and a second directional component parallel to a direction in which the belt-loop material is fed by the feeding device, and wherein the connection-portion positioning device further comprises a support member which supports the leaf spring member such that the leaf spring member extends in the oblique direction.

2. An apparatus according to claim 1, wherein the positioning device further comprises a changing device for changing a distance between the guide member and the support member in said direction extending parallel to the width.

3. An apparatus for supplying, to a sewing device, a connected belt-loop material including at least one connection portion where two long materials are connected to each other, the connection portion having a width greater than a substantially constant width of a remaining portion of the belt-loop material, the apparatus comprising:

a feeding device which feeds the belt-loop material toward the sewing device; and a positioning device which positions, in a direction extending parallel to the width of the belt-loop material, the remaining portion of the belt-loop material being fed by the feeding device, so that the remaining portion takes a first reference position in said direction extending parallel to the width, wherein the positioning device comprises a connection-portion positioning device which permits the connection to be fed by the feeding device, while positioning the connection portion in said direction extending parallel to the width so that the connection portion takes a second reference position in the direction of width, and wherein the connection-portion positioning device comprises two movable guide members which cooperate with each other to guide each of the connection portion and the remaining portion of the belt-loop material being fed by the feeding device, and thereby position the connection portion at the second reference position and the remaining portion at the first reference position equal to the second reference position; and a moving device for simultaneously moving the two guide members in opposite directions parallel to said direction extending parallel to the width, respectively, such that respective distances of the two guide members from a reference line are kept equal to each other.

4. An apparatus according to claim 3, wherein the moving device comprises two rack members which are fixed to the two movable guide members, respectively, and each of which has a plurality of teeth arranged in said direction extending parallel to the width; and a pinion which is rotatable about an axis line perpendicular to said direction extending parallel to the width and which is engaged with the teeth of each of the two rack members.

5. An apparatus according to claim 4, wherein the moving device further comprises at least one biasing device which biases the two movable guide members toward each other and which permits the two guide members to be moved away from each other.

6. An apparatus according to claim 4, wherein the moving device further comprises an actuator which moves one of the two movable guide members in each one of said opposite directions, and thereby moves the other guide member in the other direction.

7. An apparatus according to claim 6, wherein the moving device further comprises a detector provided on an upstream side of the guide members in a direction in which the belt-loop material is fed by the feeding device, the detector detecting the connection portion and generating a detection signal indicating that the detector has detected the connection portion; and a control device which controls the actuator based on the detection signal.

8. An apparatus according to claim 7, wherein the detector comprises a sensor which detects at least one of a width and a thickness of each of the connection portion and the remaining portion of the belt-loop material.

9. An apparatus for supplying, to a sewing device, a connected belt-loop material including at least one connection portion where two long materials are connected to each other, the connection portion having a width greater than a substantially constant width of a remaining portion of the belt-loop material, the apparatus comprising:

a feeding device which feeds the belt-loop material toward the sewing device; and a positioning device which positions, in a direction extending parallel to the width of the belt-loop material, the remaining portion of the belt-loop material being fed by the feeding device, so that the remaining portion takes a first reference position in said direction extending parallel to the width, wherein the positioning device comprises a connection-portion positioning device which permits the connection portion to be fed by the feeding device, while positioning the connection portion in said direction extending parallel to the width so that the connection portion takes a second reference position in the direction extending parallel to the width, and wherein the connection-portion positioning device comprises a first biasing device which biases each of the connection portion and the remaining portion of the belt-loop material being fed by the feeding device, in one of opposite directions parallel to said direction extending parallel to the width; and a second biasing device which biases said each of the connection portion and the remaining portion in the other direction and cooperates with the first biasing device to position the connection portion at the second reference position and the remaining portion at the first reference position equal to the second reference position.

10. An apparatus according to claim 9, wherein the first biasing device comprises at least one first leaf spring member which extends in a first oblique direction having a first directional component parallel to said one direction and a second directional component parallel to a feeding direction in which the belt-loop material is fed by the feeding device, and the second biasing device comprises at least one second leaf spring member which extends in a second oblique direction having a third directional component parallel to said other direction and a fourth directional component parallel to the feeding direction.

11. An apparatus for supplying to a sewing device, a connected belt-loop material including at least one connection portion where two long materials are connected to each other, the connection portion having a width greater than a substantially constant width of a remaining portion of the belt-loop material, the apparatus comprising:

a feeding device which feeds the belt-loop material toward the sewing device; and a positioning device which is, while the belt-loop material is fed by the feeding device, selectively placed in a first state in which the positioning device positions, in a direction extending parallel to the width of the belt-loop material, the remaining portion of the belt-loop material so that the remaining portion takes a reference position in said direction extending parallel to the width, and in a second state in which the positioning device permits, without positioning the connection portion in said direction extending parallel to the width, the connection portion to be fed by the feeding device.

12. An apparatus according to claim 11, wherein the positioning device comprises two guide members which, in said first state, cooperate with each other to guide the remaining portion of the belt-loop material being fed by the feeding device, and thereby position the remaining portion at the reference position in said direction extending parallel to the width; and a moving device which in said second state, moves one of the two guide members in said direction extending parallel to the width to a position where said one guide member is distant from the other guide member by more than the width of the connection portion.

13. An apparatus according to claim 2, wherein the positioning device further comprises a detector provided on an upstream side of the guide members in a direction in which the belt-loop material is fed by the feeding device, the detector detecting the connection portion and generating a detection signal indicating that the detector has detected the connection portion; and a control device which controls the moving device based on the detection signal.

14. An apparatus according to claim 13, wherein the detector comprises a sensor which detects at least one of a thickness and a width of each of the connection portion and the remaining portion of the belt-loop material.

15. An apparatus for supplying, to a sewing device, a connected belt-loop material including at least one connection portion where two long materials are connected to each other, the connection portion having a width greater than a substantially constant width of a remaining portion of the belt-loop material, the apparatus comprising:

a feeding device which feeds the belt-loop material toward the sewing device; and a positioning device which positions, in a direction extending parallel to the width of the belt-loop material, each of the connection portion and the remaining portion of the belt-loop material being fed by the feeding device, such that a first center line of the connection portion is aligned, in said direction of width, with a second center line of the remaining portion, the first and second center lines being parallel to a direction in which the belt-loop material is fed by the feeding device.

16. An apparatus according to claim 15, wherein the positioning device comprises two guide members which cooperate with each other to guide the remaining portion of the belt-loop material being fed by the feeding device, and thereby position the remaining portion in said direction extending parallel to the width; and a changing device for changing a distance between the two guide members in said direction of width, depending upon the width of the remaining portion.

17. An apparatus according to claim 15, wherein the positioning device comprises a biasing device which biases the remaining portion in said direction extending parallel to the width, and thereby positions the remaining portion in the direction extending parallel to the width.

18. A sewing system, comprising:

a sewing machine having two sewing needles;

a belt-loop-material supplying apparatus for supplying, to the sewing machine, a connected belt-loop material including at least one connection portion where two long materials are connected to each other, the connection portion having a width greater than a substantially constant width of a remaining portion of the belt-loop material, the supplying apparatus comprising a feeding device which feeds the belt-loop material toward the sewing machine, and a positioning device which positions, in a direction extending parallel to the width of the belt-loop material, at least the remaining portion of the belt-loop material being fed by the feeding device, so that the remaining portion takes a reference position in said direction of width, the positioning device permitting the connection portion of the belt-loop material to be fed through the positioning device by the feeding device, without lowering an accuracy with which the remaining portion of the belt-loop material is positioned by the positioning device in said direction extending parallel to the width;

a cutting device which is provided on a downstream side of the positioning device of the supplying apparatus in a direction in which the belt-loop material is fed by the feeding device of the supplying apparatus, the cutting device cutting the belt-loop material supplied by the supplying apparatus, into a plurality of belt-loop pieces;

a belt-loop-piece bending device which is provided between the cutting device and the sewing machine and which bends opposite end portions of each of the belt-loop pieces; and the two sewing needles of the sewing machine respectively sewing the bent opposite end portions of said each belt-loop piece to a garment material.

19. A sewing system according to claim 18, wherein the positioning device of the supplying apparatus is provided adjacent to the cutting device, and wherein the positioning device positions a predetermined length of the remaining portion of the belt-loop material being fed by the feeding device, at the reference position relative to the cutting device in said direction extending parallel to the width.

20. A sewing system according to claim 18, wherein the cutting device comprises a V-shaped-end cutter which cuts the belt-loop material into the belt-loop pieces each of which has two V-shaped cut ends.

* * * * *